US006570464B1

(12) United States Patent
Tanabe et al.

(10) Patent No.: US 6,570,464 B1
(45) Date of Patent: May 27, 2003

(54) HIGH FREQUENCY APPARATUS

(75) Inventors: Mitsuru Tanabe, Osaka (JP); Mitsuru Nishitsuji, Osaka (JP); Yoshiharu Anda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/648,498

(22) Filed: Aug. 25, 2000

(30) Foreign Application Priority Data

Aug. 27, 1999 (JP) ..... 11-242279

(51) Int. Cl.[7] ..... H01P 5/00; H01P 3/00
(52) U.S. Cl. ..... 333/34; 333/238
(58) Field of Search ..... 333/238, 34, 33, 333/246

(56) References Cited

U.S. PATENT DOCUMENTS 5,075,645 A 12/1991 Eda et al. ..... 333/34
5,293,140 A * 3/1994 Higgins ..... 333/204
5,986,525 A * 11/1999 Sasaki et al. ..... 333/203
6,097,263 A * 8/2000 Mueller et al. ..... 333/17.1
6,215,377 B1 * 4/2001 Douriet ..... 333/247
6,216,020 B1 * 4/2001 Findikoglu ..... 505/210

* cited by examiner

*Primary Examiner*—Benny T. Lee
*Assistant Examiner*—Stephen E. Jones
(74) *Attorney, Agent, or Firm*—Snell & Wilmer, LLP

(57) ABSTRACT

A high frequency apparatus includes a dielectric substrate having a surface including a first area and at least one second area; a first dielectric thin layer provided on a portion of a first area; and a uniplanar transmission line provided on the first dielectric thin layer and on a portion of the second area, the uniplanar transmission line extending, continuously on the second area and the first dielectric thin layer.

25 Claims, 24 Drawing Sheets

210
213
209
211
212
202
229
L
C

HIGH FREQUENCY APPARATUS

BACKGROUND OF THE INVENTION

1. Field of the Invention

The present invention relates to a high frequency apparatus, specifically a high frequency apparatus including a uniplanar transmission line as a transmission line.

2. Description of the Related Art

In the coming 21st century, an advanced information and communication society fully equipped with information and communication infrastructure is expected to come. The demand for mobile communication terminals represented by cellular phones will be enhanced, and communication services having a higher speed and a larger capacity, for example, outdoor data communications services and moving picture communications services will be demanded. However, the frequency band currently used for cellular phones is not sufficiently wide for the high speed, large capacity communications. Therefore, a higher frequency band, i.e., a broader, millimeter wave band should be used.

When a higher frequency band is used, the wavelength of electromagnetic waves is shortened, and thus transmission lines used in a circuit are preferably shorter than the transmission lines in a conventional frequency band. When the transmission lines are unnecessarily long, the transmission loss is increased, resulting in deterioration in the performance of the circuit. Accordingly, when a higher frequency band is used, the size of the circuit is inevitably reduced. This requires conventional multi-chip ICs (MICs), including active elements and/or passive elements assembled on a substrate, to be replaced by monolithic microwave ICs (MMICs) including active elements and/or passive elements integrally produced on a substrate by semiconductor processing.

A GaAs substrate has a resistance of $\rho=10^7$ Ωcm, which is about 2000 times higher than that of an Si substrate. Therefore, a transmission line having a small transmission loss can be formed on the GaAs substrate, which is impossible with the Si substrate. This feature of the GaAs substrate, in combination with satisfactory high frequency characteristics of a GaAs-based device, is useful in realizing an MMIC.

Transmission lines can be roughly classified into a biplanar type and a uniplanar type. In the case of the biplanar transmission lines represented by microstrip transmission lines, a signal line is provided on a top surface of the substrate, and grounding lines are provided on a bottom surface of the substrate. Accordingly, when the structure of the circuit requires the signal line to be grounded, via-holes are needed for connecting the signal line on the top surface of the substrate to the grounding lines on the bottom surface of the substrate. Formation of the via-holes requires the substrate to be polished until the thickness of the substrate becomes a value of about 200 μm to about150 μm or less, which needs additional steps separate from the steps for producing the active elements. This reduces the yield and increases the cost, and thus is undesirable for practical use.

In the case of the uniplanar transmission lines represented by coplanar waveguides (hereinafter, referred to as "CPWs"), a signal line and grounding lines are formed on the same surface of the substrate. Accordingly, via-holes are not necessary, and thus the bottom surface of the substrate does not need to be polished. Therefore, the CPWs are advantageous for reducing the production cost of the MMICs.

The impedance of a CPW is determined by the distance between the signal line and each of the grounding lines (hereinafter, referred to as the "line distance"). Accordingly, impedance transform performed in order to match the impedance with the load is done by changing the line distance, for example, making a stepped portion in the CPW.

FIG. 6 is a schematic plan view illustrating an exemplary structure of a conventional CPW. FIG. 7A schematically shows ideal impedance transform.

In FIG. 6, a stepped portion is formed along line S to change the line distance in order to transform the characteristic impedance of the transmission line of Zo in an area to the left of line S into Zo' in an area to the right of the line S (see FIG. 7A). However, when such a stepped portion is formed to change the line distance, parasitic impedance components (i.e., serial inductance component L and parallel capacitance component C) are generated in an area including the stepped portion and the vicinity thereof as shown in FIG. 7B. These parasitic impedance components cause an offset in the load impedance $Z_L$, and as a result, the impedance of the CPW obtained by the impedance transform is offset from the load, without satisfactorily matching the load.

FIG. 7C is a Smith chart illustrating the impedance transform shown in FIG. 7B. It is assumed that a load impedane $Z_L$ is transformed through line 1 (FIG. 7A) having a characteristic impedance Zo', using line 2 having a characteristic impedance Zo and a length of λ/4 (λ: wavelength of electromagnetic waves propagating through line 2). When line 1 is excessively short, ideally, impedance transform is performed along locus 1 (FIG. 7C). However, in actuality, the impedance $Z_L$ is offset by ΔZ due to the influence of the parasitic impedance components of the stepped portion (serial inductance component L and parallel capacitance component C). Thus, impedance transform is performed from the point of $Z_L+\Delta Z$ along locus 2. As a result, the input impedance of the CPW with respect to the input side is Zin' (FIG. 7B), not Zin (FIG. 7A) which is the intended value. Such an offset in the load impedance makes the circuit design difficult, especially in the high frequency range such as the millimeter wave band (30 GHz to 300 GHz).

When the impedance of a low impedance device such as, for example, a power FET (generally having an input impedance of, for example, about 6 Ω or less) is to be transformed into 50 Ω by a λ/4 impedance transformer, the characteristic impedance of the λ/4 transmission line should be 17 Ω or less. However, a CPW provided on a GaAs substrate can have a line distance of about 5 μm at the minimum, which provides a characteristic impedance of 30 Ω, due to the restriction by the thick film processing required by the plating method. Such a CPW is not preferable as an impedance transformer of a power device (i.e., low impedance device).

SUMMARY OF THE INVENTION

According to one aspect of the invention, a high frequency apparatus includes a dielectric substrate having a surface including a first area and at least one second area; a first dielectric thin layer provided on a portion of a first area; and a uniplanar transmission line provided on the first dielectric thin layer and on a portion of the second area, the uniplanar transmission line extending, continuously on the second area and the first dielectric thin layer.

In one embodiment of the invention, a dielectric constant of the uniplanar transmission line in the first area is different from a dielectric constant of the uniplanar transmission line in the second area.

In one embodiment of the invention, the surface of the dielectric substrate is exposed in the second area.

In one embodiment of the invention, the high frequency apparatus further includes a second dielectric thin layer provided on the second area of the surface of the dielectric substrate.

In one embodiment of the invention, a thickness of the first dielectric thin layer is larger than a thickness of the second dielectric thin layer.

In one embodiment of the invention, a thickness of the first dielectric thin layer is smaller than a thickness of the second dielectric thin layer.

In one embodiment of the invention, the first dielectric thin layer is formed of a dielectric material including an oxide of titanium.

In one embodiment of the invention, the second dielectric thin layer is formed of a dielectric material including an oxide of titanium.

In one embodiment of the invention, the first dielectric thin layer and the second dielectric thin layer are formed of a dielectric material including an oxide of titanium.

In one embodiment of the invention, the dielectric material including an oxide of titanium is $SrTiO_3$.

In one embodiment of the invention, the dielectric material including an oxide of titanium is $(Ba, Sr)TiO_3$.

In one embodiment of the invention, the first dielectric thin layer is formed of $SiO_{1-x}N_x$ ($0 \leqq x \leqq 1$).

In one embodiment of the invention, the second dielectric thin layer is formed of $SiO_{1-x}N_x$ ($0 \leqq x \leqq 1$).

In one embodiment of the invention, the first dielectric thin layer and the second dielectric thin layer are formed of $SiO_{1-x}N_x$ ($0 \leqq x \leqq 1$).

In one embodiment of the invention, the uniplanar transmission line includes a plurality of metal lines, and a line distance between the plurality of metal lines is changed in a stepped manner at a prescribed position.

In one embodiment of the invention, the line distance between the plurality of metal lines is changed in a stepped manner at an interface between the first area and the second area or the vicinity thereof.

In one embodiment of the invention, the uniplanar transmission line includes a plurality of metal lines, and a line distance between the plurality of metal lines is changed in a tapered manner at a prescribed position.

In one embodiment of the invention, the line distance between the plurality of metal lines is changed in a tapered manner at an interface between the first area and the second area or the vicinity thereof.

In one embodiment of the invention, the uniplanar transmission line is a coplanar waveguide.

In one embodiment of the invention, the dielectric substrate is a GaAs substrate.

In one embodiment of the invention, the dielectric substrate is a glass substrate.

In one embodiment of the invention, the high frequency apparatus further includes an active element on the GaAs substrate.

In one embodiment of the invention, the high frequency apparatus further includes an active element on the glass substrate.

According to another aspect of the invention, a high frequency apparatus includes a dielectric substrate; a uniplanar transmission line including a signal line and a pair of grounding lines having the signal line interposed therebetween; and a dielectric thin layer provided on a part of the dielectric substrate and below the signal line and at least a part of each of the pair of grounding lines.

Thus, the invention described herein makes possible the advantages of providing (1) a high frequency apparatus for appropriately matching the impedance with a load by suppressing the influence of parasitic impedance components, caused by a stepped portion or the like, on the load impedance so as to reduce the offset in the load impedance; and (2) a high frequency apparatus for transforming a low impedance of a load such as a power device or the like to an impedance of or around 50 Ω, which is the standard impedance, with easy and certainty.

These and other advantages of the present invention will become apparent to those skilled in the art upon reading and understanding the following detailed description with reference to the accompanying figures.

DESCRIPTION OF THE EMBODIMENTS

Hereinafter, the present invention will be described by way of illustrative examples with reference to the accompanying drawings.

EXAMPLE 1

A high frequency apparatus 100 in a first example according to the present invention will be described with reference to FIGS. 1A through 1J.

Figure 1A:
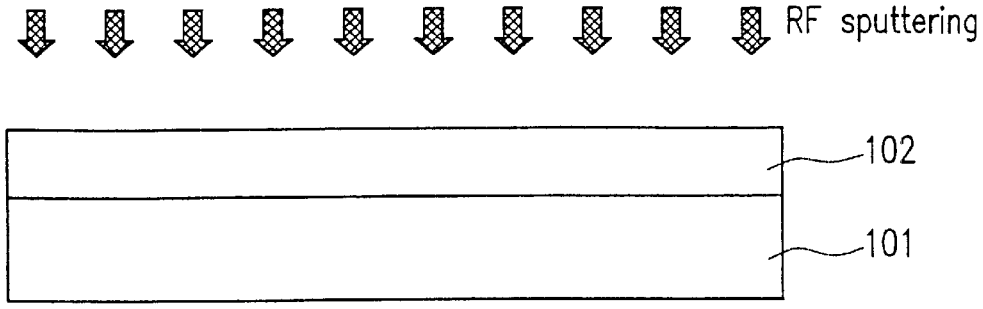
FIGS. 1A through 1D show steps of a method for producing a high frequency apparatus in a first example according to the present invention.
Figure 1B:
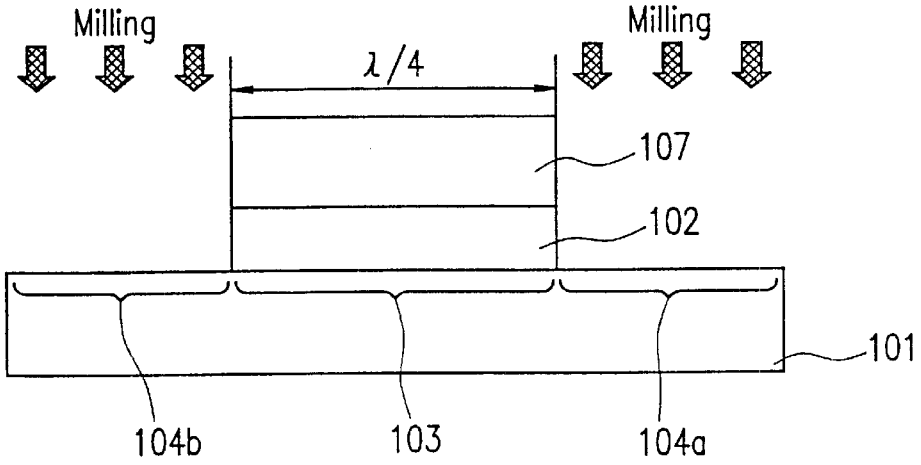
Figure 1C:
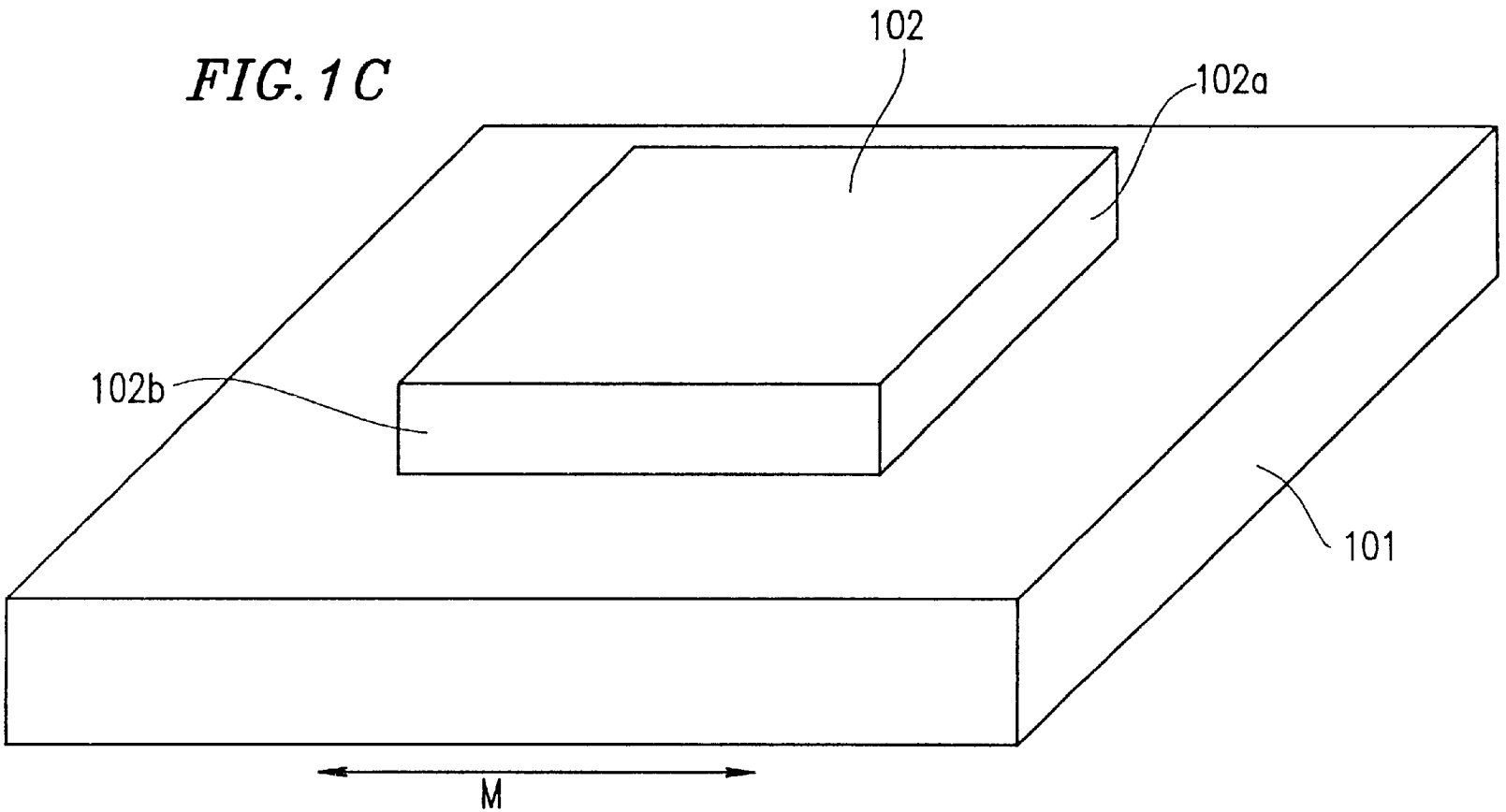
Figure 1D:
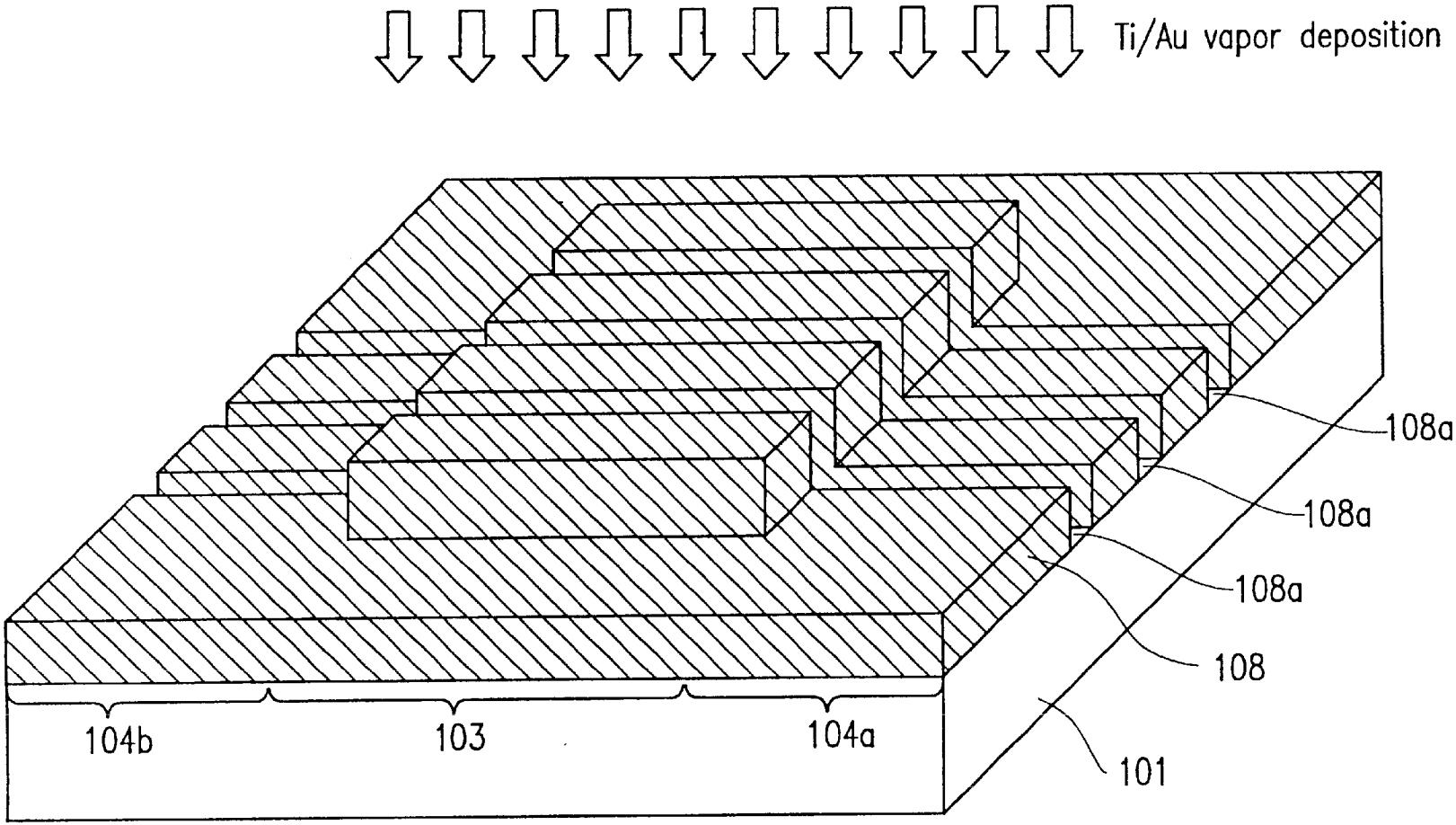
Figure 1E:
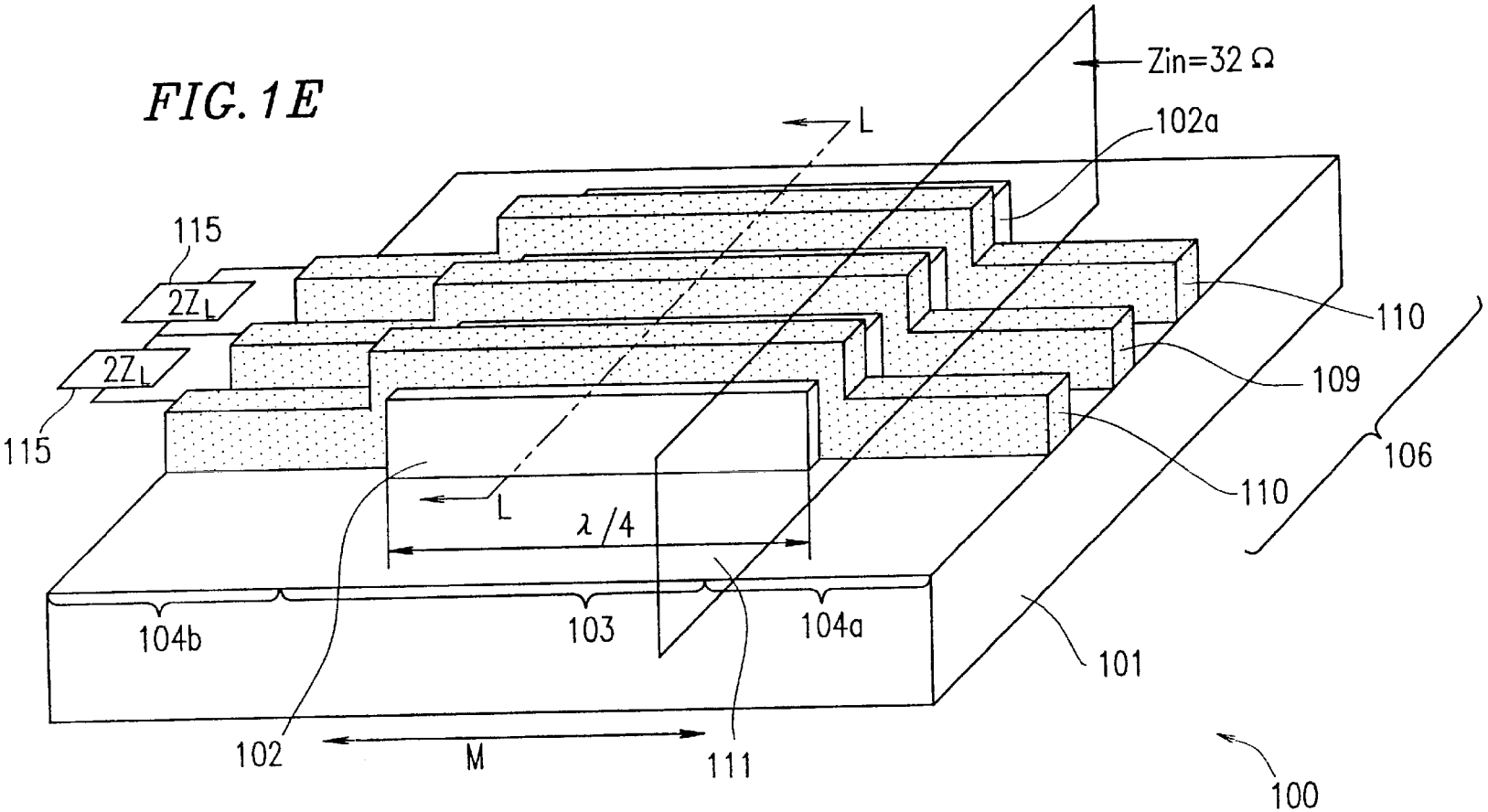
FIG. 1E is a schematic isometric view of the high frequency apparatus in the first example according to the present invention.
Figure 1F:
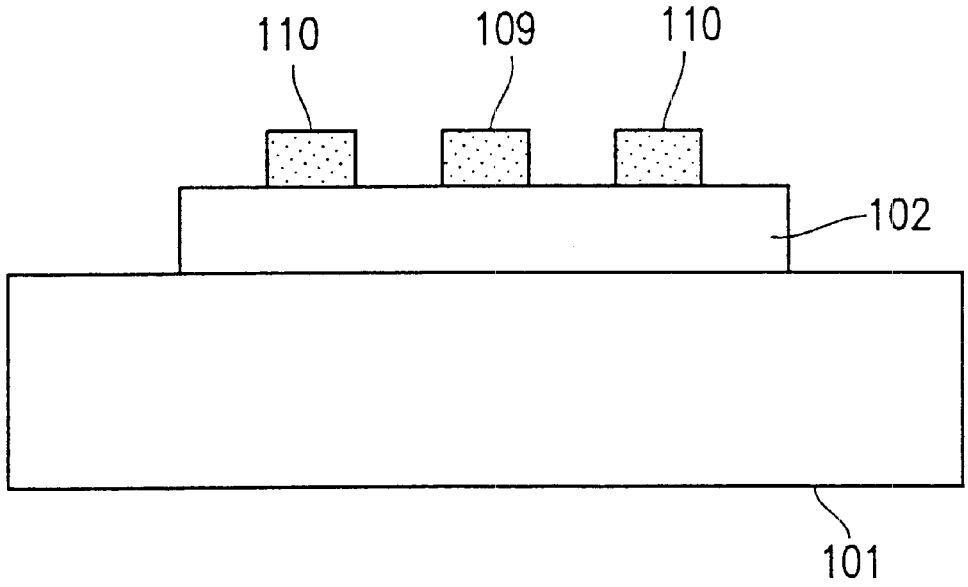
FIG. 1F is a cross-sectional view of the high frequency apparatus shown in FIG. 1D taken along line L—L.
Figure 1G:
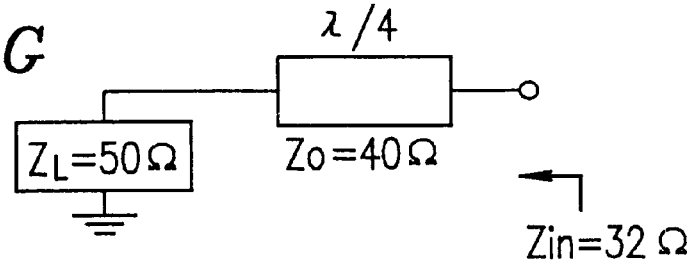
FIG. 1G shows a characteristic impedance of a coplanar waveguide included in the high frequency apparatus shown in FIG. 1E.

FIG. 1E is a schematic isometric view illustrating a structure of the high frequency apparatus 100 in the first example according to the present invention. FIG. 1F is a cross-sectional view of the high frequency apparatus 100 shown in FIG. 1E taken along line L—L in FIG. 1E. FIG. 1G schematically shows the impedance in the high frequency apparatus 100.

As shown in FIGS. 1E and 1F, the high frequency apparatus 100 includes a semi-insulating GaAs substrate 101 used as a dielectric substrate and an $SrTiO_3$ layer (STO layer) 102 (thickness X: about 1 $\mu$m) as a dielectric thin layer provided on the GaAs substrate 101. The $SrTiO_3$ layer 102 has a prescribed size and a prescribed pattern. In this example, the $SrTiO_3$ layer 102 is a rectangular parallelepiped and has a length of a side in the direction of arrow M of $\lambda/4$. Character $\lambda$ represents the wavelength of the electromagnetic waves propagating through a CPW 106 on the $SrTiO_3$ layer 102 described below. A top surface of the GaAs substrate 101 is divided into a first area 103 on which the $SrTiO_3$ layer 102 is provided and second areas 104*a* and 104*b* having the first area 103 interposed therebetween. In the second areas 104*a* and 104*b*, the GaAs substrate 101 is exposed. The high frequency apparatus 100 further includes the coplanar waveguide (CPW) 106 as a uniplanar transmission line. The CPW 106 is continuously provided along the entire length of the high frequency apparatus 100 in the direction of arrow M from the second 104*a* through the first area 103 to the second area 104*b*. The CPW 106 includes a plurality of metal lines, i.e., a pair of grounding lines 110 and a signal line 109 provided between the pair of grounding lines 110. The grounding lines 110 and the signal line 109 are each formed of a Ti/Au laminate structure (Ti thickness: about 50 nm; Au thickness: about 1 $\mu$m). The grounding lines 110 and the signal line 109 extend parallel to one another from the second area 104*a*, on the rectangular parallelepiped $SrTiO_3$ layer 102 on the first area 103, to the second area 104*b*. The $SrTiO_3$ layer 102 is in contact with the grounding lines 110 and the signal line 109 in the first area 103. The second area 104*b* is sufficiently short in the direction of arrow M to reduce the offset in the impedance transform. Beyond the second area 104*b*, loads 115 having an impedance of $2Z_L$ are connected each between the respective grounding line 110 and the signal line 109. The loads 115 are connected to each other.

As defined above, in this specification, the term "line distance" is defined as the distance between the signal line (indicated by reference numeral 109 in this example) and each of the grounding lines (indicated by reference numeral 110 in this example).

A method for producing the CPW 106 included in the high frequency apparatus 100 will be described.

As shown in FIG. 1A, the $SrTiO_3$ layer 102 is formed so as to substantially totally cover the top surface of the GaAs substrate 101 by RF sputtering at a substrate temperature of 300° C. Then, the resultant laminate is baked at 450° C. in an oxygen atmosphere. The baking recrystallizes the $SrTiO_3$ layer 102 to align the orientation of the crystals, and thus a high dielectric constant is obtained.

Next, a resist layer 107 having a quadrangular pattern having a side having a length of, for example, $\lambda/4$ ($\lambda$: wavelength of electromagnetic waves propagating through the CPW 106 on the $SrTiO_3$ layer 102) is formed on the $SrTiO_3$ layer 102 by photolithography. Then, the resist layer 107 is used as a mask to remove a part of the $SrTiO_3$ layer 102 which is not covered with the resist layer 107 by, for example, milling. Thus, as shown in FIG. 1B, the top surface of the GaAs substrate 101 is divided into the first area 103 having the $SrTiO_3$ layer 102 provided thereon and the second areas 104*a* and 104*b* which are exposed.

FIG. 1C shows a schematic view of the resultant laminate after the resist layer 107 is removed. The $SrTiO_3$ layer 102 is formed on the GaAs substrate 101. Then, as shown in FIG. 1D, a resist layer 108 is formed on the GaAs substrate 101 and the $SrTiO_3$ layer 102 by photolithography. The resist layer 108 has openings 108*a* extending from the second area 104*a* through the first area 103 to the second area 104*b*. The $SrTiO_3$ layer 102 is exposed in correspondence with the openings 108*a*. The positions of the openings 108*a* of the resist layer 108 correspond to the positions at which the signal line 109 and the grounding lines 110 of the CPW 106 will be formed.

Next, the Ti/Au laminate (thickness: about 50 nm/about 1 $\mu$m) is formed by vapor deposition. Then, the resist layer 108 and a part of the Ti/Au laminate located on the resist layer 108 are removed by lift-off, thereby leaving the Ti/Au laminate at positions corresponding to the openings 108*a*. Thus, the Ti/Au laminate structures are formed. In this manner, the high frequency apparatus 100 including the CPW 106 shown in FIG. 1E is formed.

Figure 1H:
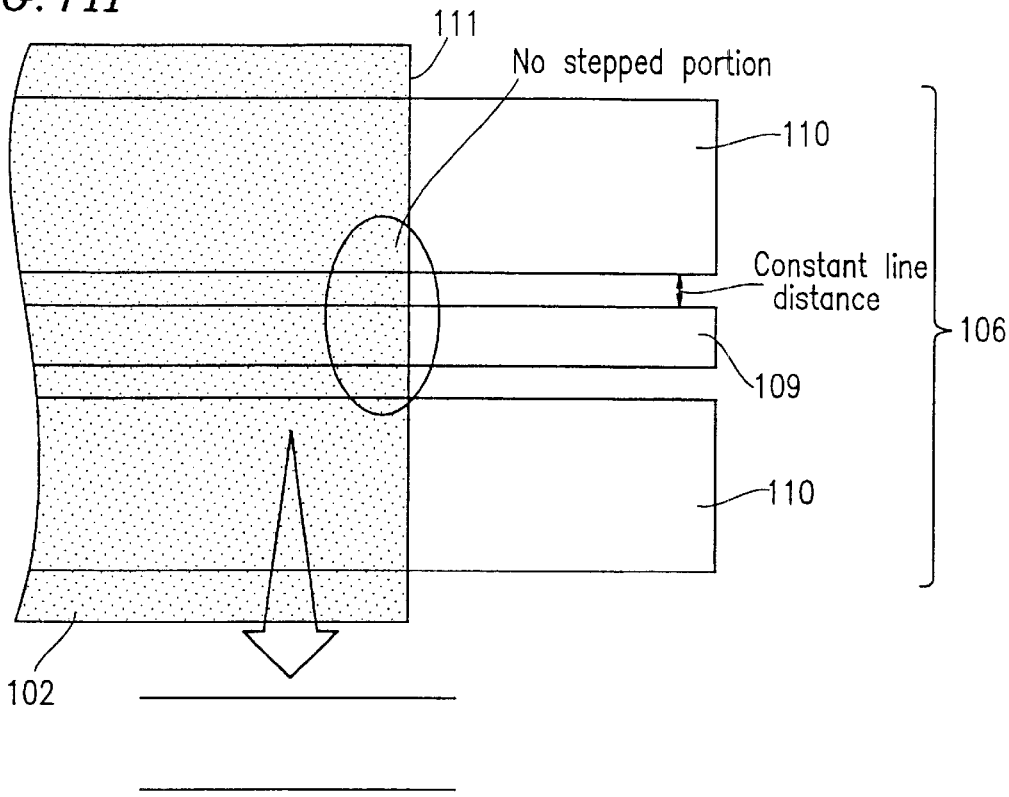
FIG. 1H is a schematic plan view of a coplanar waveguide included in the high frequency apparatus shown in FIG. 1E.
Figure 1I:
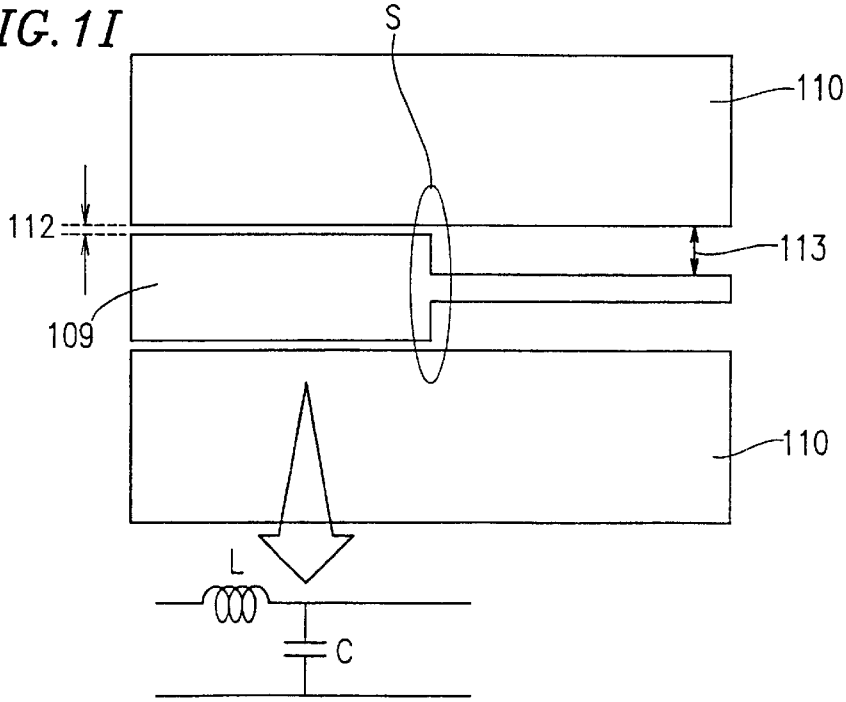
FIG. 1I is a schematic plan view of a conventional coplanar waveguide.

FIG. 1H is a schematic plan view of the CPW 106 included in the high frequency apparatus 100 shown in FIG. 1E and an equivalent circuit thereof. FIG. 1I is a schematic plan view of the conventional CPW and an equivalent circuit thereof.

In the CPW 106 shown in FIG. 1E, the $SrTiO_3$ layer 102 is provided on a part of the top surface of the GaAs substrate 101 (first area 103). Due to such a structure, the dielectric constant of the CPW 106 in the first area 103 can be made different from that in the second areas 104*a* and 104*b*. Thus, as can be appreciated from FIG. 1H, the characteristic impedance of the CPW 106 can be made different between the first area 103 and the second area 104*a* at an interface 111 between first area 103 and the second area 104*a* (corresponding to an end surface 102*a* of the $SrTiO_3$ layer 102 shown in FIG. 1E), without changing the line distance as in the conventional CPW. Since there is no need for forming a stepped portion for changing the line distance, the equivalent circuit shown in FIG. 1H does not have any serial inductance component L or parallel capacitance component C, which is generated in the conventional CPW at the stepped portion.

The CPW 106 shown in FIG. 1E has, for example, the following characteristic impedance. Where the line distance between the signal line 109 and each of the grounding metal elements 110 is 35 $\mu$m and the relative dielectric constant of the $SrTiO_3$ layer 102 is 200, the characteristic impedance is 40 Ω in the first area 103 and 50 Ω in the second area 104*a*. The first area 103 acts as a $\lambda/4$ impedance transformer. Accordingly, as shown in FIG. 1G, when $Z_L$ is 50 Ω, the input impedance Zin of the first area 103 with respect to the interface 111 between the first area 103 and the second area 104*a* is 32 Ω since the second area 104*b* is sufficiently short. Conversely, when $Z_L$ is 32 Ω, the impedance can be transformed from 32 Ω to 50 Ω.

By contrast, in order to obtain a characteristic impedance of 40 Ω with the single line and the grounding lines being provided directly on the GaAs substrate 101 without the $SrTiO_3$ layer 102, the line distance between the signal line and each of the grounding lines needs to be 15 $\mu$m. In order to obtain a characteristic impedance of 50 Ω with the signal line and the grounding lines being provided directly on the GaAs substrate 101 without the $SrTiO_3$ layer 102 like in the second area 104*a*, the line distance between the signal line and each of the grounding lines needs to be 35 $\mu$m.

In order to achieve the impedance transform as achieved by the present invention without providing the $SrTiO_3$ layer 102 (i.e., without dividing the top surface of the GaAs substrate 101 into the first area 103 and the second area 104*a* and 104*b*), the structure shown in FIG. 1I is required. That is, the signal line and the grounding lines having a line distance 112 (about 15 $\mu$m) so as to provide a characteristic impedance of 40 Ω are connected to the signal line and the grounding lines having a line distance 113 wider than the line distance 112 (about 50 $\mu$m) so as to provide a characteristic impedance of 50 Ω. A stepped portion S is formed, where the line distance changes. The stepped portion brings about the parasitic impedance components L and C shown in the equivalent circuit of FIG. 1I, which causes an offset from the ideal impedance transform.

According to the present invention, there is no stepped portion in the line pattern due to the difference in the line distance. Thus, ideal impedance transform can be performed.

The CPW 106 provided on the $SrTiO_3$ layer 102 has a low impedance. The reason will be described below.

The characteristic impedance of a transmission line is approximately represented by $Z=(L/C)^{1/2}$ (L is the inductance per unit length; C is the capacitance per the unit length). The CPW 106 has both the signal line 109 and the grounding lines 110 on the same surface of the GaAs substrate 101, and therefore the capacitance of the metal lines 109 and 110 is determined by the dielectric constant in the vicinity of the top surface of the GaAs substrate 101. Accordingly, when a thin film having a high relative dielectric constant such as, for example, the $SrTiO_3$ (STO) layer 102 ($\epsilon r$-about 200) is provided on the top surface of the GaAs substrate 101, the relative dielectric constant of the thin layer significantly influences the GaAs substrate 101 even when the thin film has a thickness of only about 1 $\mu$m. Therefore, the characteristic impedance of the CPW 106 formed on the $SrTiO_3$ layer 102 is lower than that of a CPW formed directly on the GaAs substrate 101 and having the same line distance as that of the CPW 106.

Figure 1J:
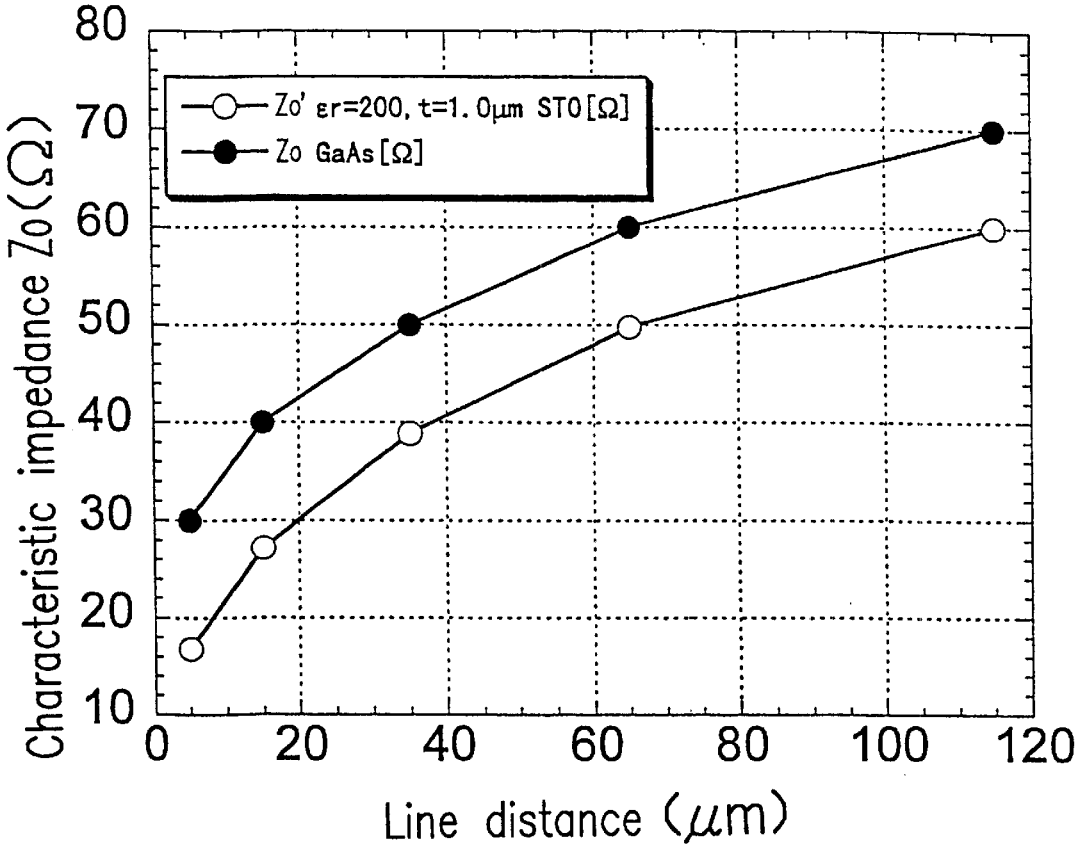
FIG. 1J is a graph illustrating the relationship between the line distance and the characteristic impedance of the high frequency apparatus shown in FIG. 1E and a conventional high frequency apparatus having the conventional coplanar waveguide.

FIG. 1J is a graph illustrating the relationship between the line distance and the characteristic impedance. The curve with black circles indicates the relationship obtained with the CPW provided directly on the GaAs substrate with no $SrTiO_3$ layer. The value of the characteristic impedance are experimental values. The curve with white circles indicates the relationship obtained with the CPW 106 provided on the $SrTiO_3$ layer 102 on the GaAs substrate 101. The value of the characteristic impedance are obtained by calculation using an electromagnetic field simulator. The $SrTiO_3$ layer 102 has a dielectric constant of $\epsilon r=200$ and a thickness of t=1 $\mu$m as described above. It is appreciated that the characteristic impedance of the CPW 106 provided on the $SrTiO_3$ layer 102 is lower than that of the CPW provided directly on the GaAs substrate when the line distance of the two types of CPWs is the same.

Instead of the $SrTiO_3$, layer 102, a layer formed of $Ba_xSr_{1-x}TiO_3$, (0<=x<=1), $Pb_xLa_yZr_{1-x-y}TiO_3$ (0<=x, 0<=y, 0<=x+y<=1), or $Ta_2O_5$ is usable. An $SiO_{1-x}N_x$ (0<=x<=1) layer can be further provided in order to realize prescribed impedance transform. Regardless of the material of the thin film provided on the GaAs substrate 101, the thin film (e.g., $SrTiO_3$ layer 102) can also be provided on the second areas 104*a* and 104*b* to a different thickness from that of the thin film on the first area 103, instead of exposing the second areas 104*a* and 104*b* in order to realize prescribed impedance transform.

Instead of the CPW 106, a slot transmission line can be used as a uniplanar transmission line.

On the GaAs substrate 101, another thin layer formed of, for example, SrO, $Ir_xO_{1-x}$ (0<=x<1), $Ru_xO_{1-x}$ (0<=x<1), $Ta_2O_5$, $CeO_2$ or $CaF_2$ can be provided, on which the $SrTiO_3$ layer 102 is provided. Since these materials satisfactorily match the lattice of the $SrTiO_3$ and have a sufficiently proximate line expansion coefficient to that of $SrTiO_3$, the $SrTiO_3$ layer 102 grown on the layer formed of any of these materials has a satisfactory crystallinity. The $SrTiO_3$ layer 102 can be grown on an $SiN_{1-x}O_x$ (0<x<=1) layer, which has a satisfactory adhesiveness with GaAs.

Instead of the GaAs substrate 101, a GaAs or InP substrate including an epitaxial film having an active element can be used. In this case, an MMIC including an impedance transformer having a structure described in this example can be produced.

Instead of the GaAs substrate 101, it is also possible to use a glass substrate and mount an active element in place of a part of the CPW 106 or mount a circuit having an active element in place of a part of the CPW 106 in the form of a flip chip. In this case, a flip-chip assembly IC can be produced.

EXAMPLE 2

A high frequency apparatus 200 in a second example according to the present invention will be described with reference to FIGS. 2A through 2H.

Figure 2A:
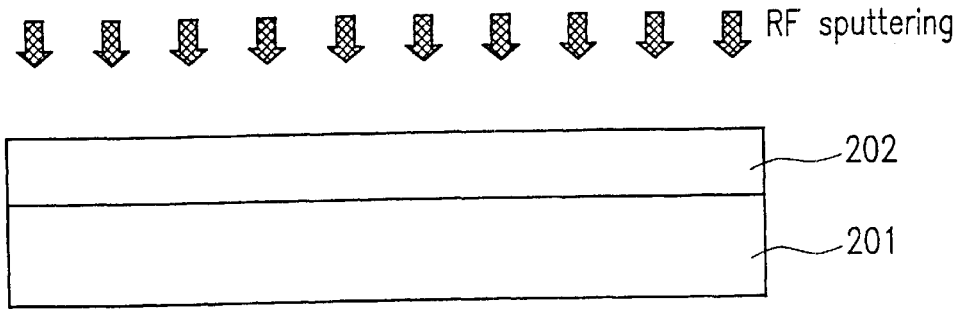
FIGS. 2A through 2C show steps of a method for producing a high frequency apparatus in a second example according to the present invention.
Figure 2B:
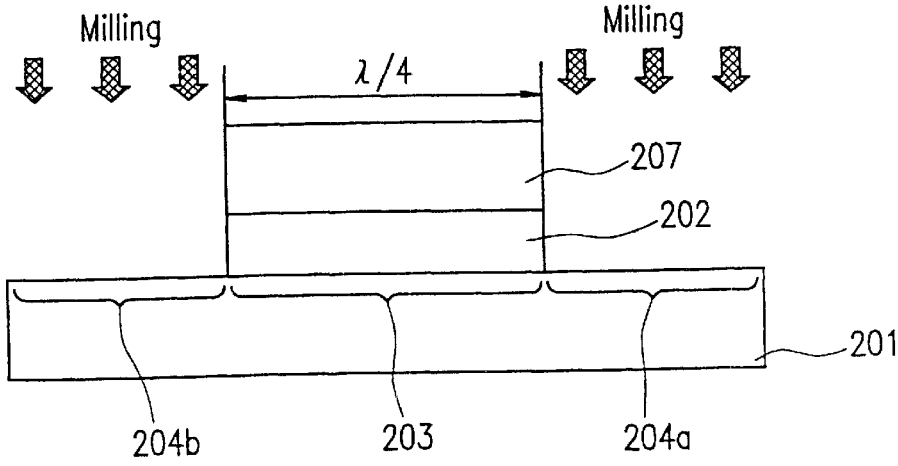
Figure 2C:
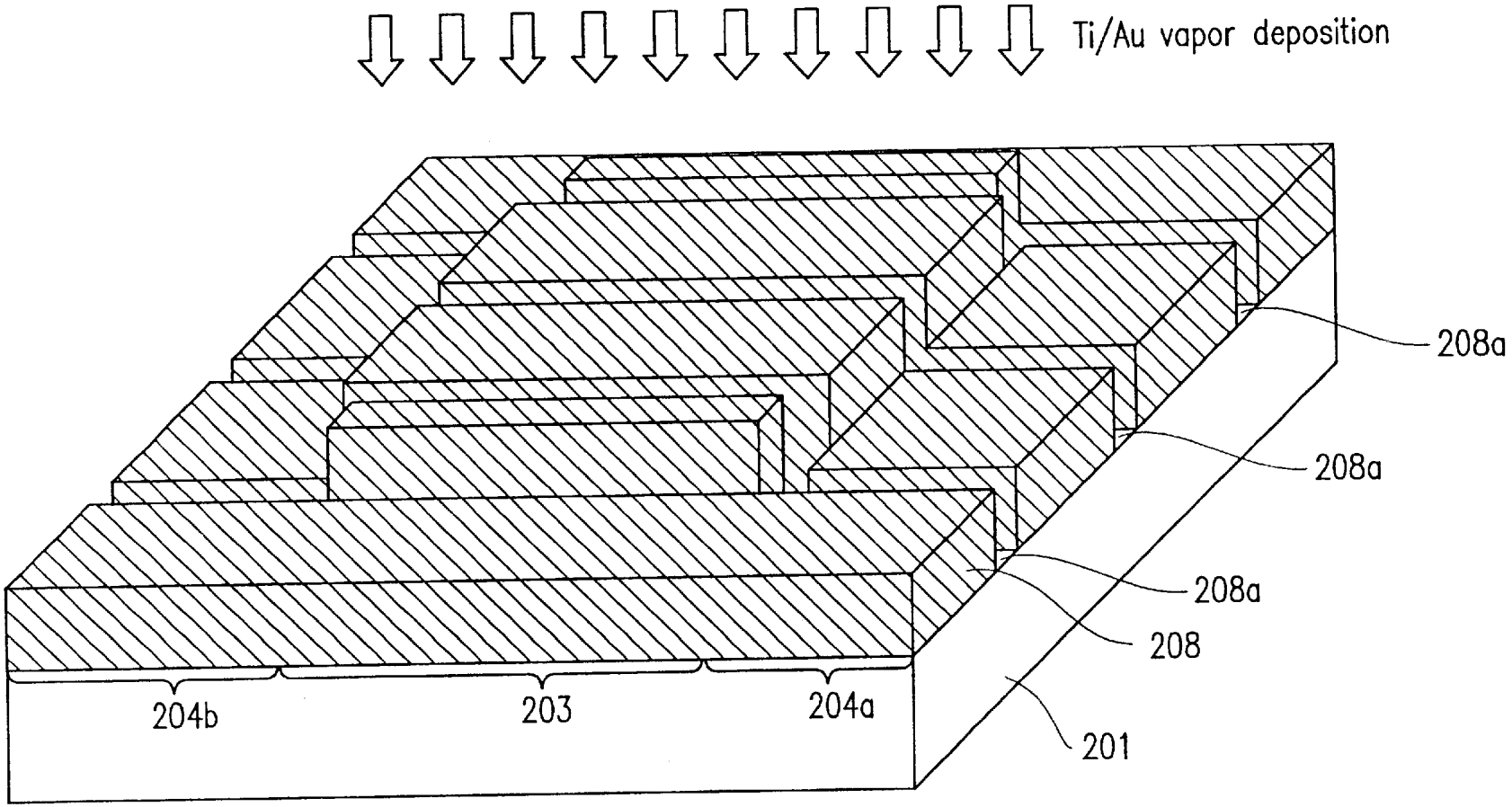
Figure 2D:
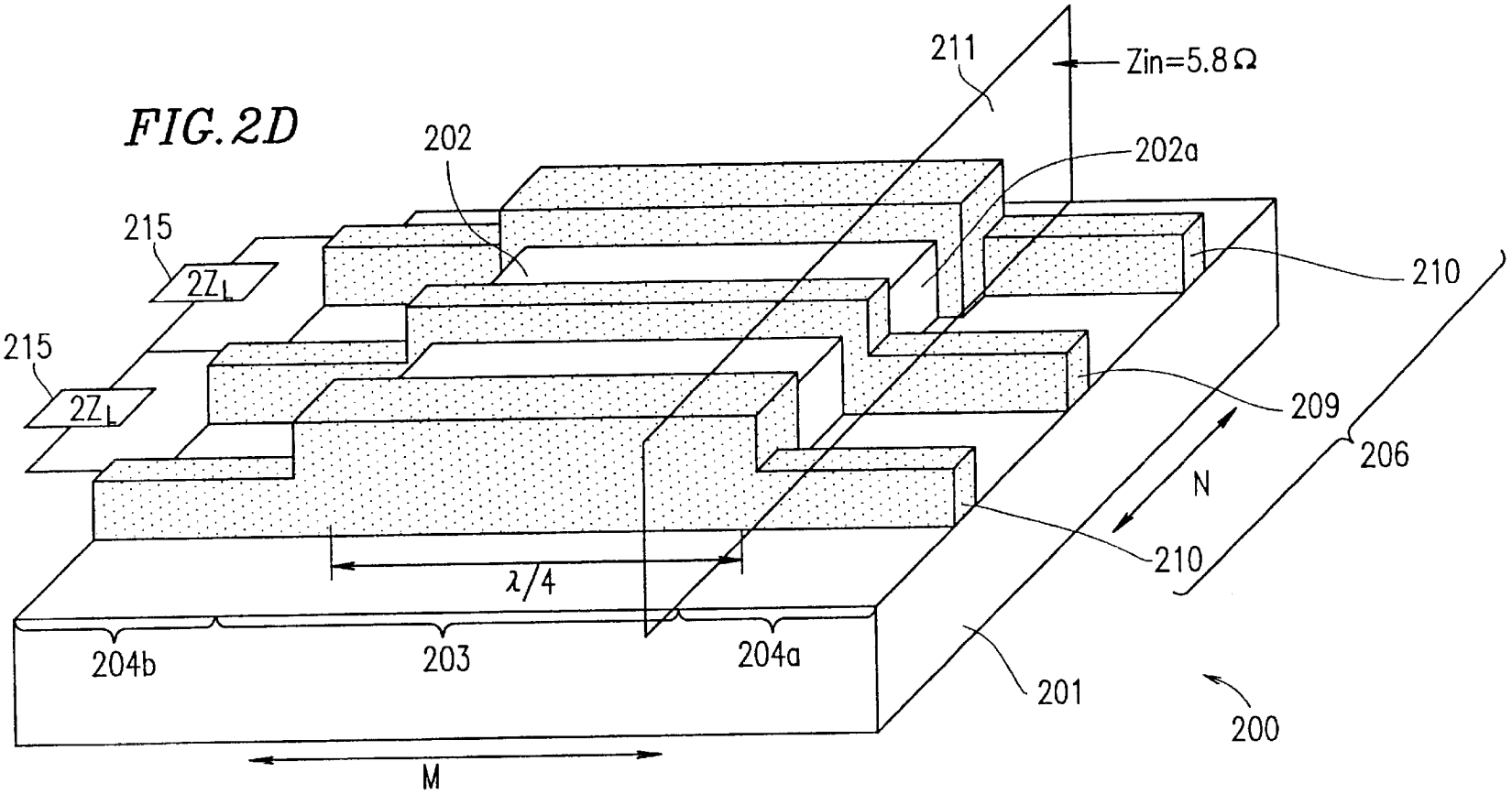
FIG. 2D is a schematic isometric view of the high frequency apparatus in the second example according to the present invention.
Figure 2E:
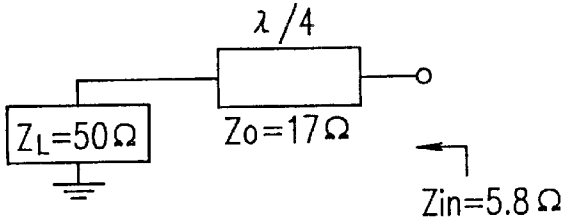
FIG. 2E shows a characteristic impedance of a coplanar waveguide included in the high frequency apparatus shown in FIG. 2D.

FIG. 2D is a schematic isometric view illustrating a structure of the high frequency apparatus 200 in the second example according to the present invention. FIG. 2E schematically shows the characteristic impedance in the high frequency apparatus 200.

As shown in FIG. 2D, the high frequency apparatus 200 includes a semi-insulating GaAs substrate 201 used as a dielectric substrate and an $SrTiO_3$ layer (STO layer) 202 (thickness: about 1 $\mu$m) as a dielectric thin layer provided on the GaAs substrate 201. The $SrTiO_3$ layer 202 has a prescribed size and a prescribed pattern. In this example, the $SrTiO_3$ layer 202 is a rectangular parallelepiped and has a length of a side in the direction of arrow M of $\lambda/4$. Character $\lambda$ represents the wavelength of the electromagnetic waves propagating through a CPW 206 on the $SrTiO_3$ layer 202 described below. A top surface of the GaAs substrate 201 is divided into a first area 203 on which the $SrTiO_3$ layer 202 is provided and second areas 204*a* and 204*b* having the first area 203 interposed therebetween. In the second areas 204*a* and 204*b*, The GaAs substrate 201 is exposed. The high frequency apparatus 200 further includes the coplanar waveguide (CPW) 206 as a uniplanar transmission line. The CPW 206 is continuously provided along the entire length of the high frequency apparatus 200 in the direction of arrow M from the second area 204*a* through the first area 203 to the second area 204*b*. The CPW 206 includes a pair of grounding lines 210 and a signal line 209 provided between the pair of grounding lines 210. The grounding lines 210 and the signal line 209 are each formed of a Ti/Au laminate structure (Ti thickness: about 50 nm; Au thickness: about 1 $\mu$m). The second area 204*b* is sufficiently short in the direction of arrow M to reduce the offset in the impedance transform. Beyond the second area 204*b*, loads 215 having an impedance of $2Z_L$ are connected each between the respective grounding line 210 and the signal line 209. The loads 215 are connected to each other.

Unlike in the first example, the line distance between each of grounding lines 210 and the signal line 209 is changed at an interface 211 between the first area 203 and the second area 204*a*. Like in the first example, the signal line 209 extends from the second area 204*a*, on the rectangular parallelepiped $SrTiO_3$ layer 202 on the first area 203, to the second area 204*b*. The width (size in the direction of arrow N) of the signal line 209 is consistent throughout the length thereof (direction of arrow M). The grounding lines 210 also extend from the second area 204*a*, on the rectangular parallelepiped $SrTiO_3$ layer 202 on the first area 203, to the second area 204*b*. The width (size in the direction of arrow N) of each grounding line 210 is larger in the first area 203 than in the second areas 204*a* and 204*b*. The grounding lines 210 cover both end faces (corresponding to end faces 102*b* of the rectangular parallelepiped $SrTiO_3$ layer 202 where the end faces are defined by the direction of arrow N. The end faces correspond to end faces 102*b* shown in FIG. 1C (only one is shown in FIG. 1C).

A method for producing the CPW 206 included in the high frequency apparatus 200 will be described.

As shown in FIG. 2A, the $SrTiO_3$ layer 202 is formed so as to substantially totally cover the top surface of the GaAs substrate 201 by RF sputtering at a substrate temperature of 300° C. Then, the resultant laminate is baked at 450° C. in an oxygen atmosphere. The baking recrystallizes the $SrTiO_3$ layer 202 to align the orientation of the crystals, and thus a high dielectric constant is obtained.

Next, a resist layer 207 having a quadrangular pattern having a side having a length of, for example, $\lambda/4$ ($\lambda$: wavelength of electromagnetic waves propagating through the CPW 206 on the $SrTiO_3$ layer 202) is formed on the $SrTiO_3$ layer 202 by photolithography. Then, the resist layer 207 is used as a mask to remove a part of the $SrTiO_3$ layer 202 which is not covered with the resist layer 207 by, for example, milling. Thus, as shown in FIG. 2B, the top surface of the GaAs substrate 201 is divided into the first area 203 having the $SrTiO_3$ layer 202 provided thereon and the second areas 204*a* and 204*b* which are exposed.

After the resist layer 207 is removed, a resist layer 208 is formed on the GaAs substrate 201 and the $SrTiO_3$ layer 202 by photolithography as shown in FIG. 2C. The resist layer 208 has openings 208*a* extending from the second area 204*a* through the first area 203 to the second area 204*b*. The $SrTiO_3$ layer 202 is exposed in correspondence with the openings 208*a*. The positions of the openings 108*a* of the resist layer 208 correspond to the positions at which the signal line 209 and the grounding lines 210 of the CPW 206 will be formed.

Next, the Ti/Au laminate (thickness: about 50 nm/about 1 $\mu$m) is formed by vapor deposition. Then, the resist layer 208 and a part of the Ti/Au laminate located on the resist layer 208 are removed by lift-off, thereby leaving the Ti/Au laminate at positions corresponding to the openings 208*a*. Thus, the Ti/Au laminate structures are formed. In this manner, the high frequency apparatus 200 including the CPW 206 shown in FIG. 2D is formed.

Figures 2F, 2G, 2H:
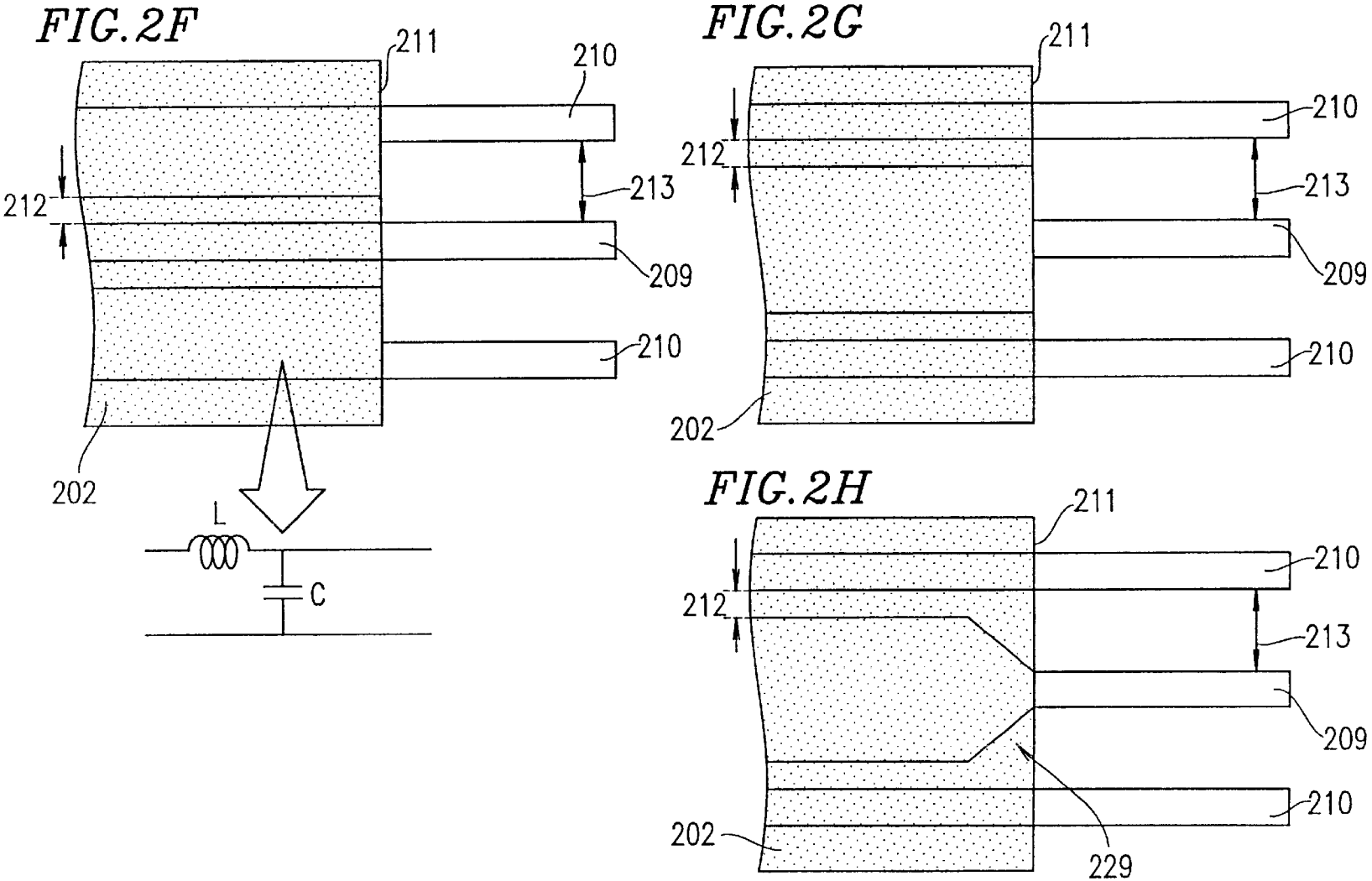
FIG. 2F is a schematic plan view of a coplanar waveguide included in the high frequency apparatus shown in FIG. 2D.
FIGS. 2G and 2H are each a schematic plan view of another coplanar waveguide which can be included in the high frequency apparatus shown in FIG. 2D.

FIG. 2F is a schematic plan view of the CPW 206 included in the high frequency apparatus 200 shown in FIG. 2D and an equivalent circuit thereof.

In the CPW 206 shown in FIG. 2D, the $SrTiO_3$ layer 202 is provided on a part of the top surface of the GaAs substrate 201 (first area 203). Due to such a structure, the dielectric constant of the CPW 206 in the first area 203 can be made different from that in the second areas 204*a* and 204*b*. In addition, as can be appreciated from FIG. 2F, the line distance of the CPW 206 (distance between the signal line 209 and each of the grounding lines 210) is changed at the interface 211 between the first area 203 and the second area 204*a* (corresponding to an end surface 202*a* of the $SrTiO_3$ layer 202 as shown in FIG. 2D). Namely, line distance 212 in the first area 203 is smaller than line distance 213 in the second area 204*a*. Accordingly, the effect provided by the different materials of the underlayers below the CPW 206 is combined with an effect provided by the changing line distance (which leads to the changing characteristic impedance). Thus, impedance transform of various impedance values can be performed. Since the impedance transform is not realized only by the changing line distance as is by the conventional CPW, the serial impedance component L and the parallel capacitance component C caused by the changing line distance (stepped portion) shown in the equivalent circuit of FIG. 2F are smaller than those in the conventional CPW. Therefore, the offset in the load impedance transform is reduced, as compared to the conventional CPW.

In FIG. 2F, the narrower line distance 212 is changed to the wider line distance 213 by changing the width of the grounding lines 210 while keeping the width of the signal line 209 consistent throughout the length thereof. Alternatively, a structure shown in FIG. 2G is usable. In FIG. 2G, the narrower line distance 212 is changed to the wider line distance 213 by changing the width of the signal line 209 while keeping the width of the grounding lines 210 consistent throughout the length thereof.

Still alternatively, a structure shown in FIG. 2H is usable. In FIG. 2H, the signal line 209 includes a tapered portion 229, so that the narrower line distance 212 is changed to the wider line distance 213 more gradually than in FIGS. 2F and 2G.

The line distance can be changed at any other appropriate point instead of along the interface 211.

The CPW 206 shown in FIG. 2D has, for example, the following characteristic impedance. Where the narrower line distance 212 between the signal line 209 and each of the grounding metal elements 210 is 5 μm and the relative dielectric constant of the $SrTiO_3$ layer 202 is 200, the characteristic impedance is 17 Ω in the first area 203 and 50 Ω in the second area 204*a*. The first area 203 acts as a λ/4 impedance transformer. Accordingly, as shown in FIG. 2E, when $Z_L$ is 50 Ω, the input impedance Zin of the first area 203 with respect to the interface 211 between the first area 203 and the second area 204*a* is 5.8 Ω since the second area 204*b* is sufficiently short. Conversely, when $Z_L$ is 5.8 Ω, the impedance can be transformed from 5.8 Ω to 50 Ω.

The input impedance of a power device is generally about 6 Ω when the gate width is Wg=600 μm. Accordingly, when the λ/4 impedance transformer having a structure according to the present invention is used, the impedance can be transformed into 50 Ω by only the λ/4 impedance transformer. The characteristic impedance of 17 Ω described above cannot be realized with a CPW directly provided on the GaAs substrate but can be realized by the structure according to the present invention.

The CPW 206 provided on the $SrTiO_2$ layer 202 has a low impedance for the same reason as described in the first example with reference to FIG. 13.

Instead of the $SrTiO_3$ layer 202, a layer formed of $Ba_xSr_{1-x-y}TiO_3$ ($0 \leqq x \leqq 1$), $Pb_xLa_yZr_{1-x}TiO_3$ ($0 \leqq x$, $0 \leqq y$, $0 \leqq x+y \leqq 1$) or $Ta_2O_5$ is usable. An $SiO_{1-x}N_x$ ($0 \leqq x \leqq 1$) layer can be further provided in order to realize prescribed impedance transform. Regardless of the material of the thin film provided on the GaAs substrate 201, the thin film (e.g., $SrTiO_3$ layer 202) can also be provided on the second areas 204*a* and 204*b* to a different thickness from that of the thin film on the first area 203, instead of exposing the second areas 204*a* and 204*b* in order to realize prescribed impedance transform.

Instead of the CPW 206, a slot transmission line can be used as a uniplanar transmission line.

On the GaAs substrate 201, another thin layer formed of, for example, SrO, $Ir_xO_{1-x}$ ($0 \leqq x \leqq 1$), $Ru_xO_{1-x}$ ($0 \leqq x \leqq 1$), $Ta_2O_5$, $CeO_2$ or $CaF_2$ can be provided, on which the $SrTiO_3$ layer 202 is provided. Since these materials satisfactorily match the lattice of the $SrTiO_3$ and have a sufficiently proximate line expansion coefficient to that of $SrTiO_3$, the $SrTiO_3$ layer 202 grown on the layer formed of any of these materials has a satisfactory crystallinity. The $SrTiO_3$ layer 202 can be grown on an $SiN_{1-x}O_x$ ($0 \leqq x \leqq 1$) layer, which has a satisfactory adhesiveness with GaAs.

Instead of the GaAs substrate 201, a GaAs or InP substrate including an epitaxial film having an active element can be used. In this case, an MMIC including an impedance transformer having a structure described in this example can be produced.

Instead of the GaAs substrate 201, it is also possible to use a glass substrate and mount an active element in place of a part of the CPW 206 or mount a circuit having an active element in place of a part of the CPW 206 in the form of a flip chip. In this case, a flip-chip assembly IC can be produced.

EXAMPLE 3

A high frequency apparatus 300 in a third example according to the present invention will be described with reference to FIGS. 3A through 3I.

Figure 3A:
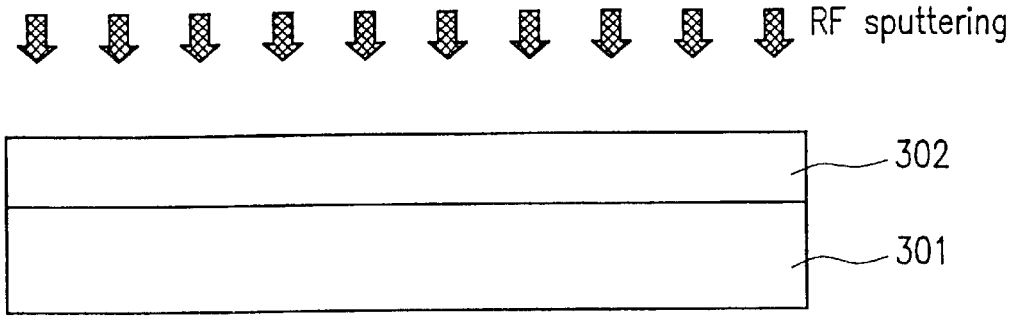
FIGS. 3A through 3E show steps of a method for producing a high frequency apparatus in a third example according to the present invention.
Figure 3B:
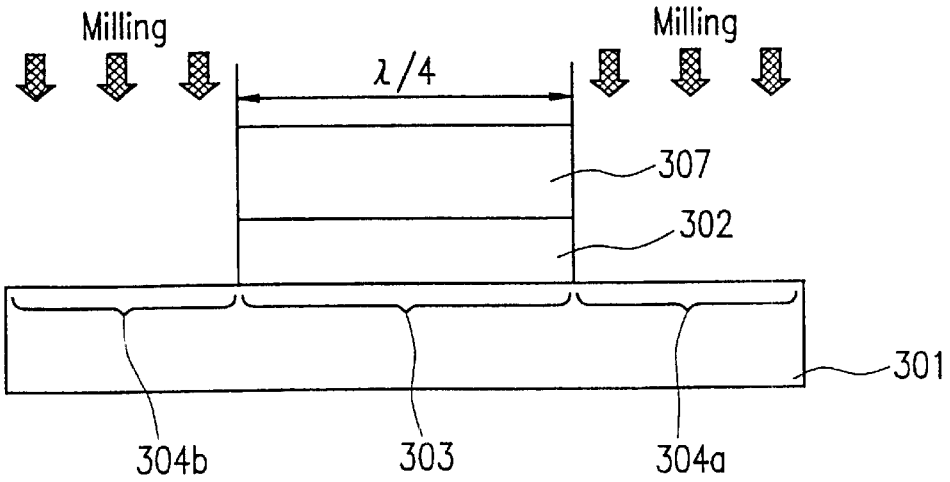
Figure 3C:
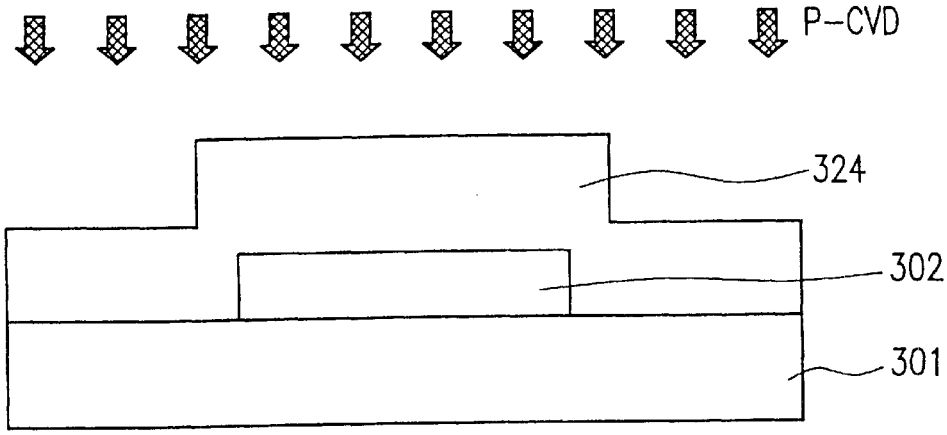
Figure 3D:
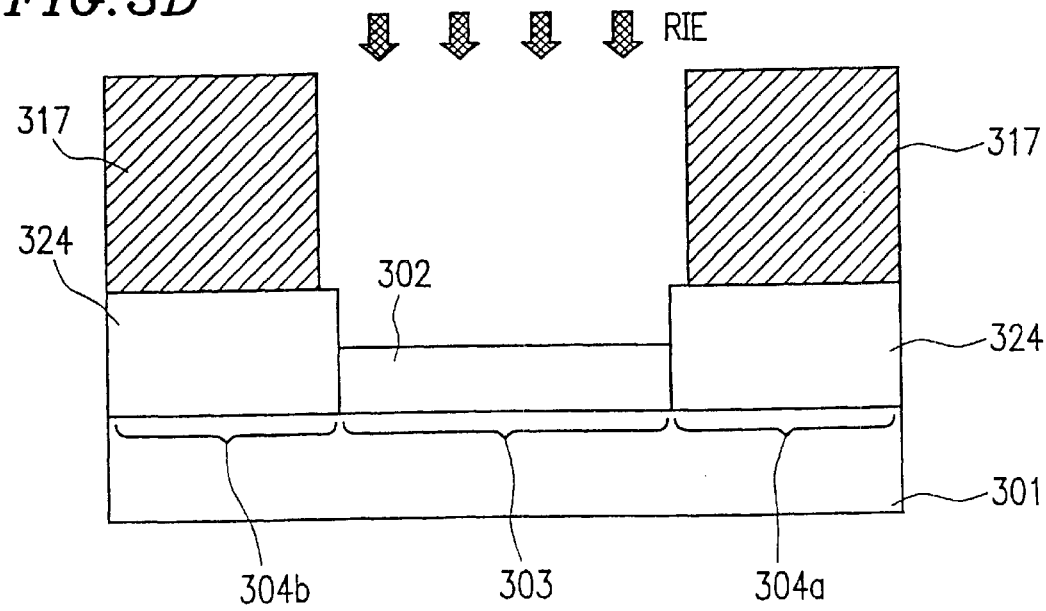
Figure 3E:
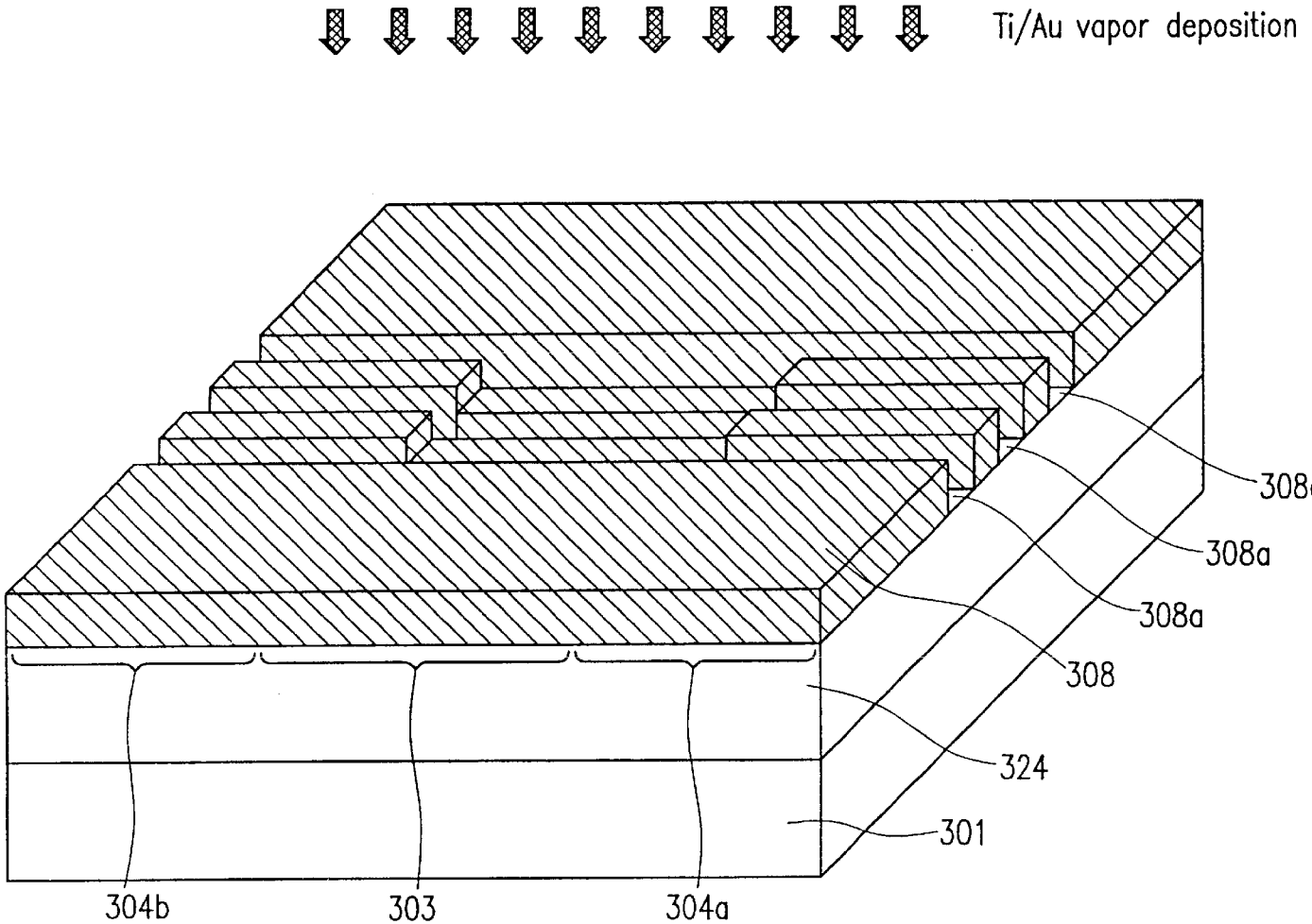
Figures 3F, 3G:
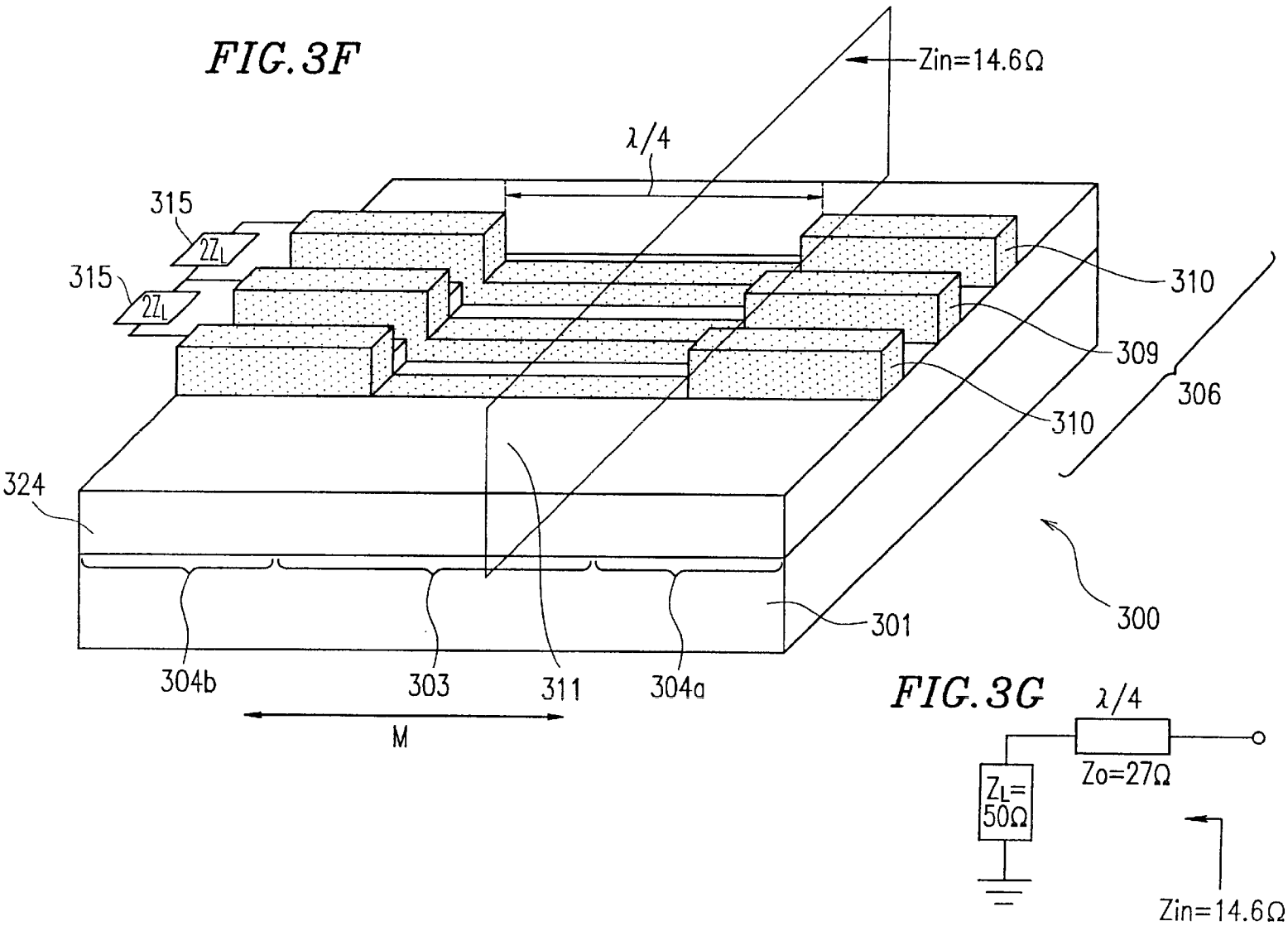
FIG. 3F is a schematic isometric view of the high frequency apparatus in the third example according to the present invention.
FIG. 3G shows a characteristic impedance of a coplanar waveguide included in the high frequency apparatus shown in FIG. 3F.

FIG. 3F is a schematic isometric view illustrating a structure of the high frequency apparatus 300 in the third example according to the present invention. FIG. 3G schematically shows the characteristic impedance in the high frequency apparatus 300.

As shown in FIG. 3F, the high frequency apparatus 300 includes a semi-insulating GaAs substrate 301 used as a dielectric substrate and an $SrTiO_3$ layer (STO layer) 302 (thickness: about 1 μm; shown in FIGS. 3A through 3D) as a dielectric thin layer provided on the GaAs substrate 301. The $SrTiO_3$ layer 302 has a prescribed size and a prescribed pattern. In this example, the $SrTiO_3$ layer 302 is a rectangular parallelepiped and has a length of a side in the direction of arrow M of λ/4. Character λ represents the wavelength of the electromagnetic waves propagating through a CPW 306 on the $SrTiO_3$ layer 302 described below. The high frequency apparatus 300 further includes an $SiO_2$ layer 324 (thickness: about 5 μm) provided on the GaAs substrate 301 so as to surround the $SrTiO_3$ layer 302. Thus, a top surface of the GaAs substrate 301 is divided into a first area 303 on which the $SrTiO_3$ layer 302 is provided and second areas 304*a* and 304*b* having the first area 303 interposed therebetween. The high frequency apparatus 300 still further includes the coplanar waveguide (CPW) 306 as a uniplanar transmission line. The CPW 306 is continuously provided along the entire length of the high frequency apparatus 300 in the direction of arrow M from the second area 304*a* through the first area 303 to the second area 304*b*. The CPW 306 includes a pair of grounding lines 310 and a signal line 309 provided between the pair of grounding lines 310. The grounding lines 310 and the signal line 309 are each formed of a Ti/Au laminate structure (Ti thickness: about 50 nm; Au thickness: about 1 μm). The grounding lines 310 and the signal line 309 extend parallel to one another from the second area 304*a*, on the rectangular parallelepiped $SrTiO_3$ layer 302 on the first area 303, to the second area 304*b*. The second area 304*b* is sufficiently short in the direction of arrow M to reduce the offset in the impedance transform. Beyond the second area 304*b*, loads 315 having an impedance of $2Z_L$ are connected each between the respective grounding line 310 and the signal line 309. The loads 315 are connected to each other.

A method for producing the CPW 306 included in the high frequency apparatus 300 will be described.

As shown in FIG. 3A, the $SrTiO_3$ layer 302 is formed so as to substantially totally cover the top surface of the GaAs substrate 301 by RF sputtering at a substrate temperature of 300° C. Then, the resultant laminate is baked at 450° C. in an oxygen atmosphere. The baking recrystallizes the $SrTiO_3$ layer 302 to align the orientation of the crystals, and thus a high dielectric constant is obtained.

Next, a resist layer 307 having a quadrangular pattern having a side having a length of, for example, λ/4 (λ: wavelength of electromagnetic waves propagating through the CPW 306 on the $SrTiO_3$ layer 302) is formed on the $SrTiO_3$ layer 302 by photolithography. Then, the resist layer 307 is used as a mask to remove a part of the $SrTiO_3$ layer 302 which is not covered with the resist layer 307 by, for example, milling. Thus, as shown in FIG. 3B, the top surface of the GaAs substrate 301 is divided into the first area 303 having the $SrTiO_3$ layer 302 provided thereon and the second areas 304*a* and 304*b* which are exposed.

Next, as shown in FIG. 3C, the $SiO_2$ layer 324 is formed to a thickness of about 5 μm so as to substantially totally cover the top surface of the GaAs substrate 301, covering the $SrTiO_3$ layer 302 patterned above, by plasma CVD (P-CVD)

at a substrate temperature of 300° C. Then, as shown in FIG. 3D, a resist layer 317 having an opening positionally corresponding to the $SrTiO_3$ layer 302 is formed by photolithography on the resultant laminate, and the resist layer 317 is used as a mask to anisotropically etch away the $SiO_2$ layer 324 by reactive ion etching (RIE) using $SF_6$ as an etching gas. Then, the resist layer 317 is removed. As a result, the $SrTiO_3$ layer 302 is provided on the first area 303 and the $SiO_2$ layer 324 is provided on the second areas 304*a* and 304*b*.

Then, a resist layer 308 is formed on the $SrTiO_3$ layer 302 and the $SiO_2$ layer 324 by photolithography as shown in FIG. 3E. The resist layer 308 has openings 308*a* extending from the second area 304*a* through the first area 303 to the second area 304*b*. The positions of the openings 308*a* of the resist layer 308 correspond to the positions at which the signal line 309 and the grounding lines 310 of the CPW 306 will be formed.

Next, the Ti/Au laminate (thickness: about 50 nm/about 1 μm) is formed by vapor deposition. Then, the resist layer 308 and a part of the Ti/Au laminate located on the resist layer 308 are removed by lift-off, thereby leaving the Ti/Au laminate at positions corresponding to the openings 308*a*. Thus, the Ti/Au laminate structures are formed. In this manner, the high frequency apparatus 300 including the CPW 306 shown in FIG. 3F is formed.

In the CPW 306 shown in FIG. 3F, the $SrTiO_3$ layer 302 and the $SiO_2$ layer 324 are selectively provided on the top surface of the GaAs substrate 301. Due to such a structure, the dielectric constant of the CPW 306 in the first area 303 can be made different from that in the second areas 304*a* and 304*b*. Thus, the characteristic impedance of the CPW 306 can be made different between the first area 303 and the second area 304*a* without changing the line distance as in the conventional CPW. Modifications such as exchanging the position of the $SrTiO_3$ layer 302 and the position of the $SiO_2$ layer 324 can be made.

The CPW 306 shown in FIG. 3F has, for example, the following characteristic impedance. Where the line distance between the signal line 309 and each of the grounding metal elements 310 is 15 μm and the relative dielectric constant of the $SrTiO_3$ layer 302 is 200, the characteristic impedance is 27 Ω in the first area 303 and 50 Ω in the second area 304*a*. The first area 303 acts as a λ/4 impedance transformer. Accordingly, as shown in FIG. 3G, when $Z_L$ is 50 Ω, the input impedance Zin of the first area 303 with respect to an interface 311 between the first area 303 and the second area 304*a* is 14.6 Ω since the second area 304*b* is sufficiently short. Conversely, when $Z_L$ is 14.6 Ω, the impedance can be transformed from 14.6 Ω to 50 Ω.

By contrast, in order to obtain a characteristic impedance of 27 Ω with the signal line and the grounding lines being provided directly on the GaAs substrate 301, the line distance between the signal line and each of the grounding lines needs to be 5 μm. In order to obtain a characteristic impedance of 50 Ω with the signal line and the grounding lines being provided directly on the GaAs substrate 301 as in the second area 304*a*, the line distance between the signal line and each of the grounding lines needs to be 35 μm.

Figure 3H:
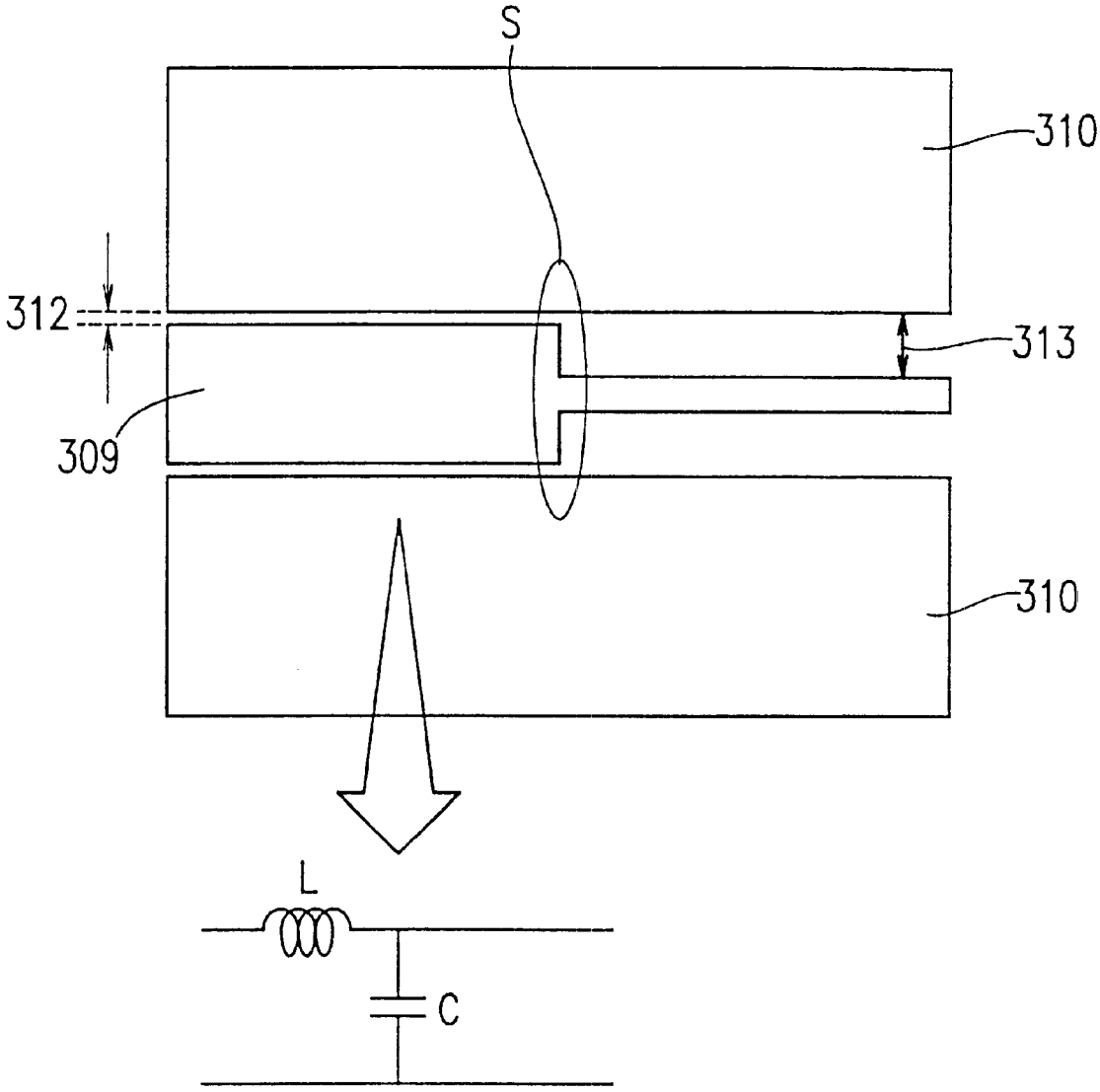
FIG. 3H is a schematic plan view of a coplanar waveguide included in the high frequency apparatus shown in FIG. 3F.

In order to achieve the impedance transform as achieved by the present invention without dividing the top surface of the GaAs substrate 301 into the first area 303 and the second area 304*a* and 304*b*, the structure shown in FIG. 3H is required. That is, the signal line and the grounding lines having a line distance 312 (about 5 μm) so as to provide a characteristic impedance of 27 Ω are connected to the signal line and the grounding lines having a line distance 313 wider than the line distance 312 (about 50 μm) so as to provide a characteristic impedance of 50 Ω. A stepped portion S is formed, where the line distance changes. The stepped portion brings about the parasitic components L and C shown in the equivalent circuit of FIG. 3H, which causes an offset from the ideal impedance transform.

According to the present invention, there is no stepped portion in the line pattern due to the difference in the line distance. Thus, ideal impedance transform can be performed.

The CPW 306 provided on the $SrTiO_3$ layer 302 has a low impedance. The reason will be described below.

The characteristic impedance of a transmission line is approximately represented by $Z=(L/C)^{1/2}$ (L is the inductance per unit length; C is the capacitance per the unit length). The CPW 306 has both the signal line 309 and the grounding lines 310 on the same surface of the GaAs substrate 301, and therefore the capacitance of the CPW 306 is determined by the dielectric constant in the vicinity of the top surface of the GaAs substrate 301. Accordingly, when a thin film having a high relative dielectric constant such as, for example, the $SrTiO_3$ (STO) layer 302 (εr=about 200) is provided on the top surface of the GaAs substrate 301, the relative dielectric constant of the thin layer significantly influences the capacitance of the CPW 306 even when the thin film has a thickness of only about 1 μm. Therefore, the characteristic impedance of the CPW 306, formed on the $SrTiO_3$ layer 302, is lower than that of a CPW, formed directly on the GaAs substrate 301 and having the line distance same as that of the CPW 306. When a thin film having a smaller relative dielectric constant than that of GaAs such as, for example, the $SiO_2$ layer 324 is provided on the GaAs substrate 301, the characteristic impedance of a CPW provided on the $SiO_2$ layer 324 is higher than that of a CPW provided directly on the GaAs substrate 301 when the line distance of the two types of CPWs is the same.

Figure 3I:
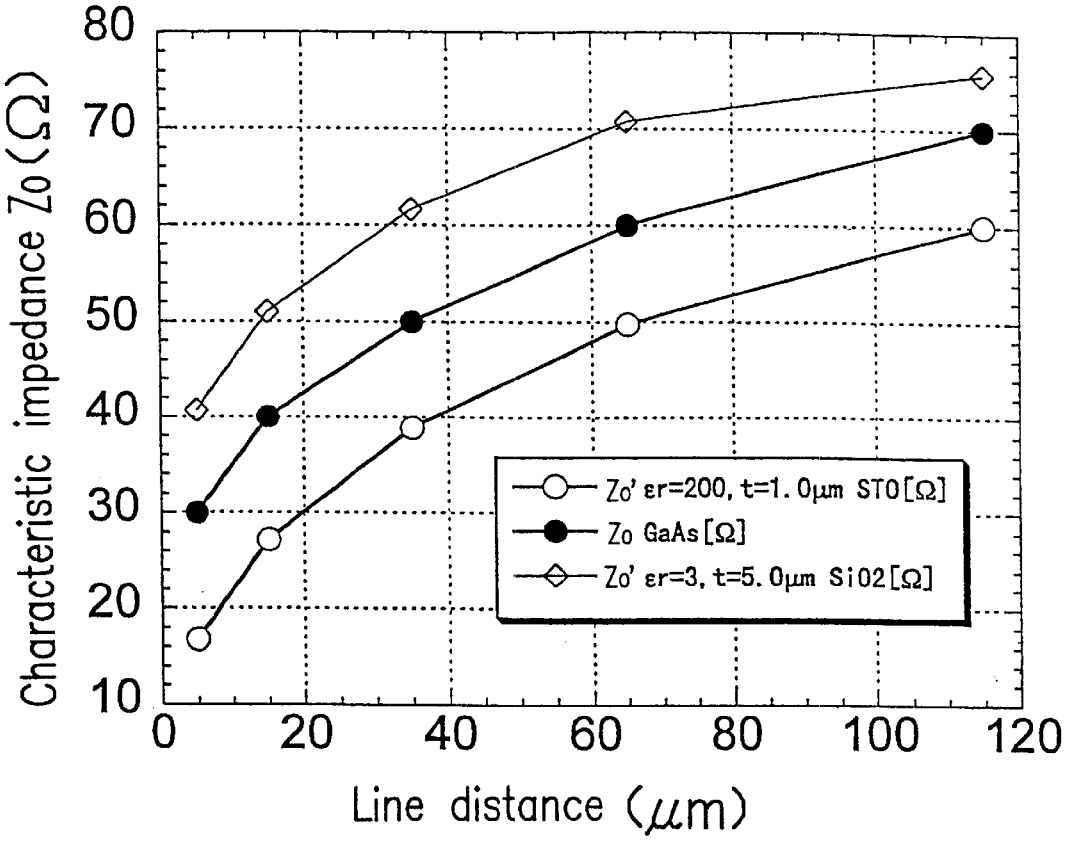
FIG. 3I is a graph illustrating the relationship between the line distance and the characteristic impedance of the high frequency apparatus shown in FIG. 3F and the conventional high frequency apparatus.

FIG. 3I is a graph illustrating the relationship between the line distance and the characteristic impedance. The curve with black circles indicates the relationship obtained with the CPW provided directly on the GaAs substrate. The values of the characteristic impedance are experimental values. The curve with white circles indicates the relationship obtained with the CPW 306 provided on the $SrTiO_3$ layer 302 on the GaAs substrate 301. The values of the characteristic impedance are obtained by calculation using an electromagnetic field simulator. The $SrTiO_3$ layer 302 has a dielectric constant of εr=200 and a thickness of t=1 μm as described above. The curve with white squares indicates the relationship obtained with the CPW provided on the $SiO_2$ layer 324 on the GaAs substrate. The values of the characteristic impedance are obtained by calculation using an electromagnetic field simulator. It is appreciated that the characteristic impedance of the CPW can be changed by changing the material of the layer below the CPW even when the line distance between the signal line and each of the grounding lines is the same. Specifically, when the line distance is the same, the characteristic impedance of the CPW 306 provided on the $SrTiO_3$ layer 302 is lower than that of the CPW provided directly on the GaAs substrate, and the characteristic impedance of the CPW provided on the $SiO_2$ layer 324 is higher than that of the CPW provided directly on the GaAs substrate.

Instead of the $SrTiO_3$ layer 302, a layer formed of $Ba_xSR_{1-x}TiO_3$ (0<=x<=1), $Pb_xLa_yZr_{1-x-y}TiO_3$ (0<=x, 0<=y, 0<=x+y<=1) or $Ta_2O_5$ is usable. Instead of SiO2 layer 324, a layer formed of $SiO_{1-x}N_x$ (0<=x<=1) is usable.

Instead of the CPW 306, a slot transmission line can be used as a uniplanar transmission line.

On the GaAs substrate 301, another thin layer formed of, for example, SrO, $Ir_xO_{1-x}$ (0<=x<1), $Ru_xO_{1-x}$ (0<=x<1), $Ta_2O_5$, $CeO_2$ or $CaF_2$ can be provided, on which the $SrTiO_3$ layer 302 is provided. Since these materials satisfactorily match the lattice of the $SrTiO_3$ and have a sufficiently proximate line expansion coefficient to that of $SrTiO_3$, the $SrTiO_3$ layer 302 grown on the layer formed of any of these materials has a satisfactory crystallinity. The $SrTiO_3$ layer 302 can be grown on an $SiN_{1-x}O_x$ (0<x<=1) layer, which has a satisfactory adhesiveness with GaAs.

Instead of the GaAs substrate 301, a GaAs or InP substrate including an epitaxial film having an active element can be used. In this case, an MMIC including an impedance transformer having a structure described in this example can be produced.

Instead of the GaAs substrate 301, it is also possible to use a glass substrate and mount an active element in place of a part of the CPW 306 or mount a circuit having an active element in place of a part of the CPW 306 in the form of a flip chip. In this case, a flip-chip assembly IC can be produced.

EXAMPLE 4

A high frequency apparatus 400 in a fourth example according to the present invention will be described with reference to FIGS. 4A through 4G.

Figure 4A:
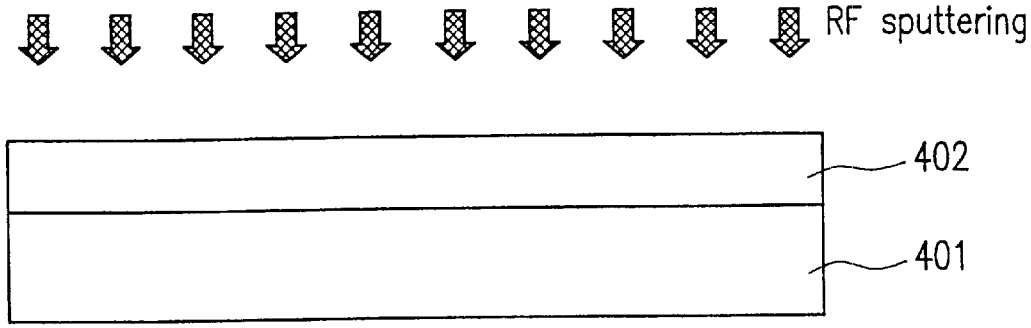
FIGS. 4A through 4E show steps of a method for producing a high frequency apparatus in a fourth example according to the present invention.
Figure 4B:
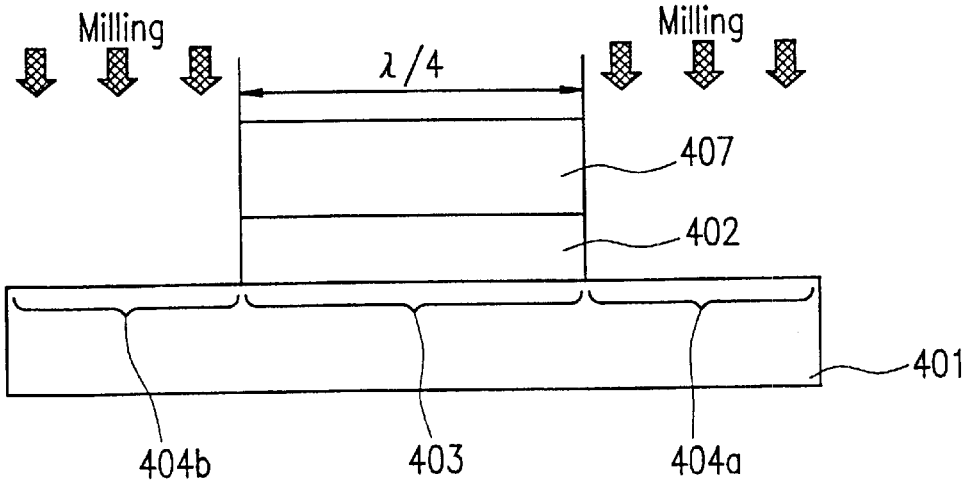
Figure 4C:
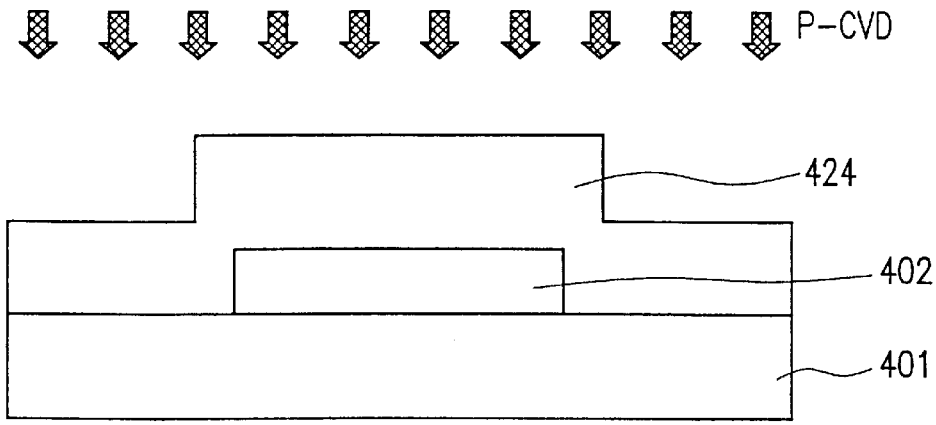
Figure 4D:
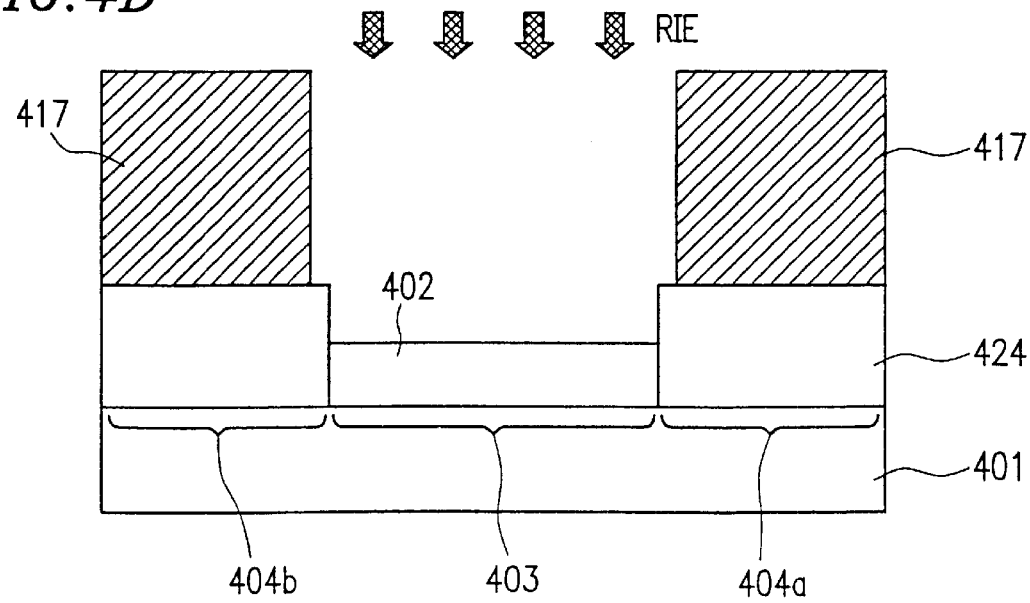
Figure 4E:
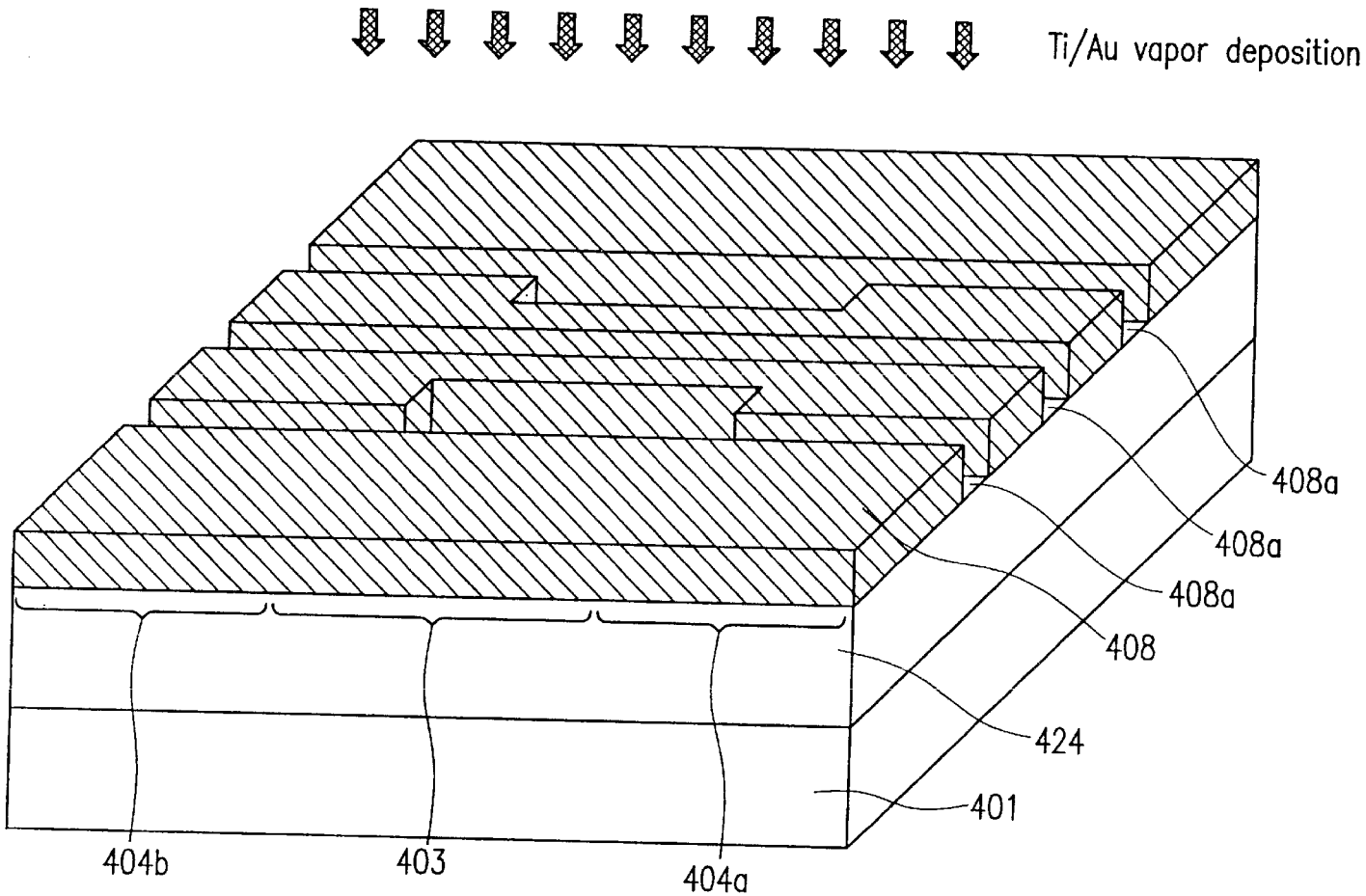
Figure 4F:
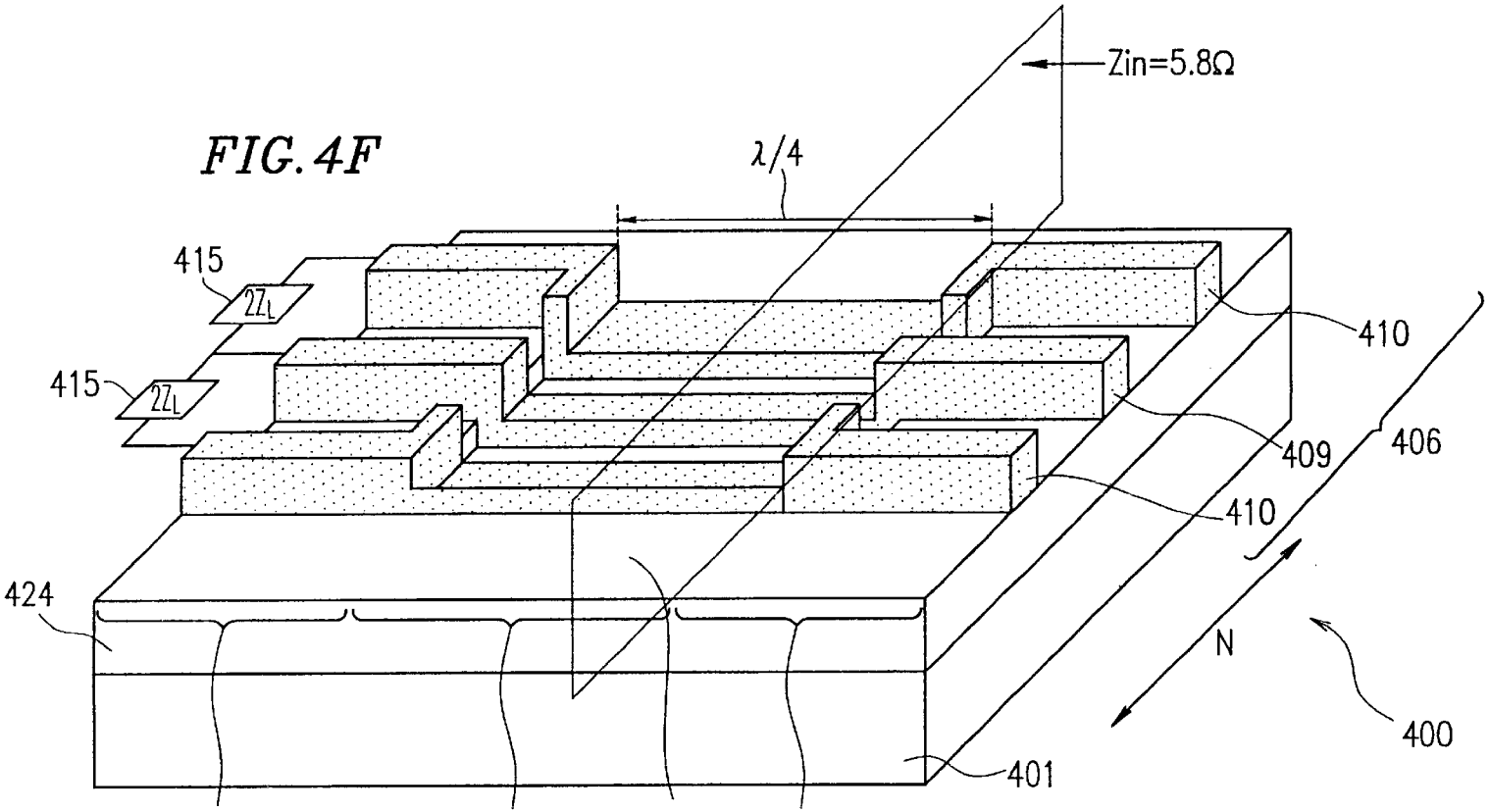
FIG. 4F is a schematic isometric view of the high frequency apparatus in the fourth example according to the present invention.
Figure 4G:
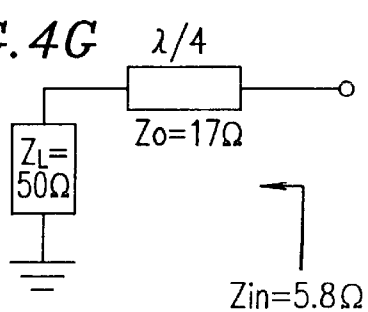
FIG. 4G shows a characteristic impedance of a coplanar waveguide included in the high frequency apparatus shown in FIG. 4F.

FIG. 4F is a schematic isometric view illustrating a structure of the high frequency apparatus 400 in the fourth example according to the present invention. FIG. 4G schematically shows the characteristic impedance in the high frequency apparatus 400.

As shown in FIG. 4F, the high frequency apparatus 400 includes a semi-insulating GaAs substrate 401 used as a dielectric substrate and an $SrTiO_3$ layer (STO layer) 402 (thickness: about 1 μm; shown in FIGS. 4A through 4D) as a dielectric thin layer provided on the GaAs substrate 401. The $SrTiO_3$ layer 402 has a prescribed size and a prescribed pattern. In this example, the $SrTiO_3$ layer 402 is a rectangular parallelepiped and has a length of a side in the direction of arrow M of λ/4. Character λ represents the wavelength of the electromagnetic waves propagating through a CPW 406 on the $SrTiO_3$ layer 402 described below. The high frequency apparatus 400 further includes an $SiO_2$ layer 424 (thickness: about 5 μm) provided on the GaAs substrate 401 so as to surround the $SrTiO_3$ layer 402. Thus, a top surface of the GaAs substrate 401 is divided into a first area 403 on which the $SrTiO_3$ layer 402 is provided and second areas 404*a* and 404*b* having the first area 403 interposed therebetween. The high frequency apparatus 400 still further includes the coplanar waveguide (CPW) 406 as a uniplanar transmission line. The CPW 406 is continuously provided along the entire length of the high frequency apparatus 400 in the direction of arrow M from the second area 404*a* through the first area 403 to the second area 404*b*. The CPW 406 includes a pair of grounding lines 410 and a signal line 409 provided between the pair of grounding lines 410. The grounding lines 410 and the signal line 409 are each formed of a Ti/Au laminate structure (Ti thickness: about 50 nm; Au thickness: about 1 μm). The second area 404*b* is sufficiently short in the direction of arrow M to reduce the offset in the impedance transform. Beyond the second area 404*b*, loads 415 having an impedance of $2Z_L$ are connected each between the respective grounding line 410 and the signal line 409. The loads 415 are connected to each other.

Unlike in the third example, the line distance between each of grounding lines 410 and the signal line 409 is changed at an interface 411 between the first area 403 and the second area 404*a*. Like in the third example, the signal line 409 extends from the second area 404*a*, on the rectangular parallelepiped $SrTiO_3$ layer 402 on the first area 403, to the second area 404*b*. The width (size in the direction of arrow N) of the signal line 409 is consistent throughout the length thereof (direction of arrow M). The grounding lines 410 also extend from the second area 404*a*, on the rectangular parallelepiped $SrTiO_3$ layer 402 on the first area 403, to the second area 404*b*. The width (size in the direction of arrow N) of each grounding line 410 is larger in the first area 403 than in the second areas 404*a* and 404*b*.

A method for producing the CPW 406 included in the high frequency apparatus 400 will be described.

As shown in FIG. 4A, the $SrTiO_3$ layer 402 is formed so as to substantially totally cover the top surface of the GaAs substrate 401 by RF sputtering at a substrate temperature of 300° C. Then, the resultant laminate is baked at 450° C. in an oxygen atmosphere. The baking recrystallizes the $SrTiO_3$ layer 402 to align the orientation of the crystals, and thus a high dielectric constant is obtained.

Next, a resist layer 407 having a quadrangular pattern having a side having a length of, for example, λ/4 (λ: wavelength of electromagnetic waves propagating through the CPW 406 on the $SrTiO_3$ layer 402) is formed on the $SrTiO_3$ layer 402 by photolithography. Then, the resist layer 407 is used as a mask to remove a part of the $SrTiO_3$ layer 402 which is not covered with the resist layer 407 by, for example, milling. Thus, as shown in FIG. 4B, the top surface of the GaAs substrate 401 is divided into the first area 403 having the $SrTiO_3$ layer 402 provided thereon and the second areas 404*a* and 404*b* which are exposed.

Next, as shown in FIG. 4C, the $SiO_2$ layer 424 is formed to a thickness of about 5 μm so as to substantially totally cover the top surface of the GaAs substrate 401, covering the $SrTiO_3$ layer 402 patterned above, by P-CVD at a substrate temperature of 300° C. Then, as shown in FIG. 4D, a resist layer 417 having an opening positionally corresponding to the $SrTiO_3$ layer 402 is formed by photolithography on the resultant laminate, and the resist layer 417 is used as a mask to anisotropically etch away the $SiO_2$ layer 424 by reactive ion etching (RIE) using $SF_6$ as an etching gas. Then, the resist layer 417 is removed. As a result, the $SrTiO_3$ layer 402 is provided on the first area 403 and the $SiO_2$ layer 424 is provided on the second areas 404*a* and 404*b*.

Then, a resist layer 408 is formed on the $SrTiO_3$ layer 402 and the $SiO_2$ layer 424 by photolithography as shown in FIG. 4E. The resist layer 408 has openings 408*a* extending from the second area 404*a* through the first area 403 to the second area 404*b*. The positions of the openings 408*a* of the resist layer 408 corresponds to the positions at which the signal line 409 and the grounding lines 410 of the CPW 406 will be formed.

Next, the Ti/Au laminate (thickness: about 50 nm/about 1 μm) is formed by vapor deposition. Then, the resist layer 408 and a part of the Ti/Au laminate located on the resist layer 408 are removed by lift-off, thereby leaving the Ti/Au laminate at positions corresponding to the openings 408*a*. Thus, the Ti/Al laminate structures are formed. In this manner, the high frequency apparatus 400 including the CPW 406 shown in FIG. 4F is formed.

In the CPW 406 shown in FIG. 4F, the $SrTiO_3$ layer 402 and the $SiO_2$ layer 424 are selectively provided on the top surface of the GaAs substrate 401. Due to such a structure, the dielectric constant of the CPW 406 in the first area 403 can be made different from that in the second areas 404*a* and 404*b*. In addition, the line distance of the CPW 406 (distance between the signal line 409 and each of the grounding lines 410) is changed at the interface 411 between the first area 403 and the second area 404*a*. Accordingly, the effect provided by the different materials of the underlayers below the CPW 406 is combined with an effect provided by the changing line distance (which leads to the changing characteristic impedance). Thus, impedance transform of various impedance values can be performed.

Modifications such as exchanging the position of the $SrTiO_3$ layer 402 and the position of the $SiO_2$ layer 424 can be made. The line distance can be changed at any other appropriate point instead of along the interface 411 as described in the second example. Also as described in the second example, the line distance can be changed by changing the width of the signal line 409. In the case where a tapered portion is provided in the signal line 409 or the grounding lines 410, the line distance can be changed more gradually.

The CPW 406 shown in FIG. 4F has, for example, the following characteristic impedance. Where the line distance between the signal line 409 and each of the grounding metal elements 410 is 5 $\mu$m and the relative dielectric constant of the $SrTiO_3$ layer 402 is 200, the characteristic impedance is 17 Ω in the first area 403 and 50 Ω in the second area 404*a*. The first area 403 acts as a $\lambda/4$ impedance transformer. Accordingly, as shown in FIG. 4G, when $Z_L$ is 50 Ω, the input impedance Zin of the first area 403 with respect to the interface 411 between the first area 403 and the second area 404*a* is 5.8 Ω since the second area 404*b* is sufficiently short. Conversely, when $Z_L$ is 5.8 Ω, the impedance can be transformed from 5.8 Ω to 50 Ω.

The input impedance of a power device is generally about 6 Ω when the gate width is Wg=600 $\mu$m. Accordingly, when the $\lambda/4$ impedance transformer having a structure according to the present invention is used, the impedance can be transformed into 50 Ω by only the $\lambda/4$ impedance transformer. The characteristic impedance of 17 Ω described above cannot be realized with a CPW directly provided on the GaAs substrate but can be realized by the structure according to the present invention.

When a CPW is provided on the $SiO_2$ layer 424 having a thickness of about 5 $\mu$m, the signal line and the grounding lines provides a characteristic impedance of 50 Ω when the line distance is 15 $\mu$m. In this case, the serial inductance component L and the parallel capacitance component C in the equivalent circuit are smaller than those of a CPW provided directly on the GaAs substrate (line distance: 35 $\mu$m) at the stepped portion. Thus, the offset from the ideal impedance transform can be kept sufficiently small.

The characteristics impedance of the CPW 406 provided on the $SrTiO_3$ layer 402 is lower than that of a CPW provided directly on the GaAs substrate, and the characteristic impedance of a CPW provided on the $SiO_2$ layer 214 is higher than that of the CPW provided directly on the GaAs substrate, for the reason described in the third example with reference to FIG. 3I.

Instead of the $SrTiO_3$, layer 402, a layer formed of $Ba_xSr_{1-x}TiO_3$ ($0<=x<=1$), $Pb_xLa_yZrO_{1-x-y}TiO_3$ ($0<=x$, $0<=y$, $0<=x+y<1$) or $Ta_2O_5$ is usable. Instead of the $SiO_2$ layer 424, a layer formed of $SiO_{1-x}N_x$ ($0<=x<1$) is usable.

Instead of the CPW 406, a slot transmission line can be used as a uniplanar transmission line.

On the GaAs substrate 401, another thin layer formed of, for example, SrO, $Ir_xO_{1-x}$, ($0<=x<1$), $Ru_xO_{1-x}$ ($0<=x<1$), $Ta_2O_5$, $CeO_2$ or $CaF_2$ can be provided, on which the $SrTiO_3$ layer 402 is provided. Since these materials satisfactorily matches the lattice of the $SrTiO_3$ and have a sufficiently proximate line expansion coefficient to that of $SrTiO_3$, the $SrTiO_3$ layer 402 grown on the layer formed of any of these materials has a satisfactory crystallinity. The $SrTiO_3$ layer 402 can be grown on an $SiN_{1-x}O_x$ ($0<x<=1$) layer, which has a satisfactory adhesiveness with GaAs.

Figure 5A:
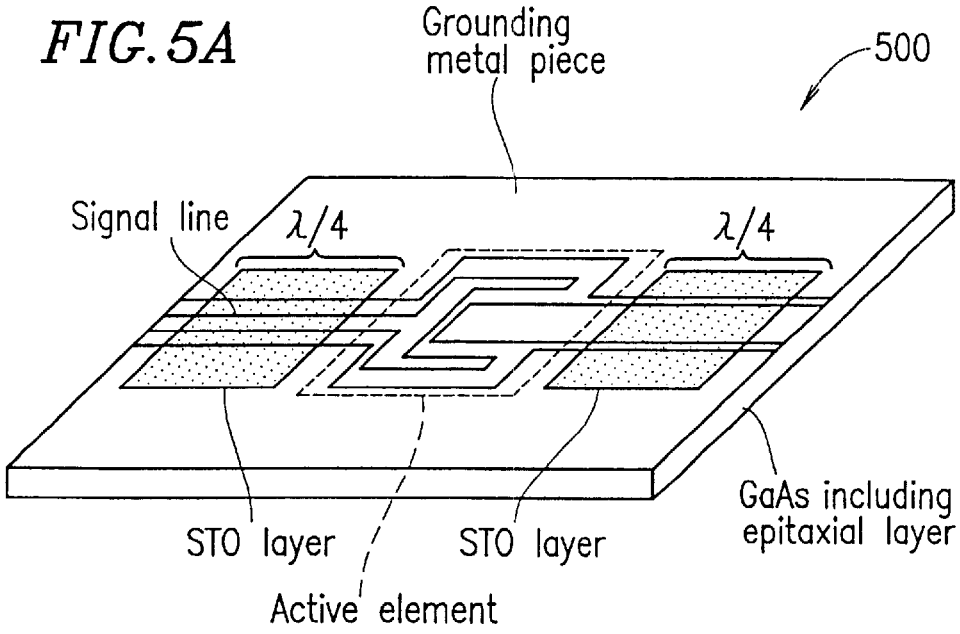
FIG. 5A is a schematic isometric view of an MMIC acting as a high frequency apparatus according to the present invention.

Instead of the GaAs substrate 401, a GaAs or InP substrate including an epitaxial film having an active element can be used. In this case, an MMIC including an impedance transformer having a structure described in this example can be produced. FIG. 5A shows an MMIC 500 acting as a high frequency apparatus according to the present invention, including a GaAs substrate having an epitaxial layer.

Figure 5B:
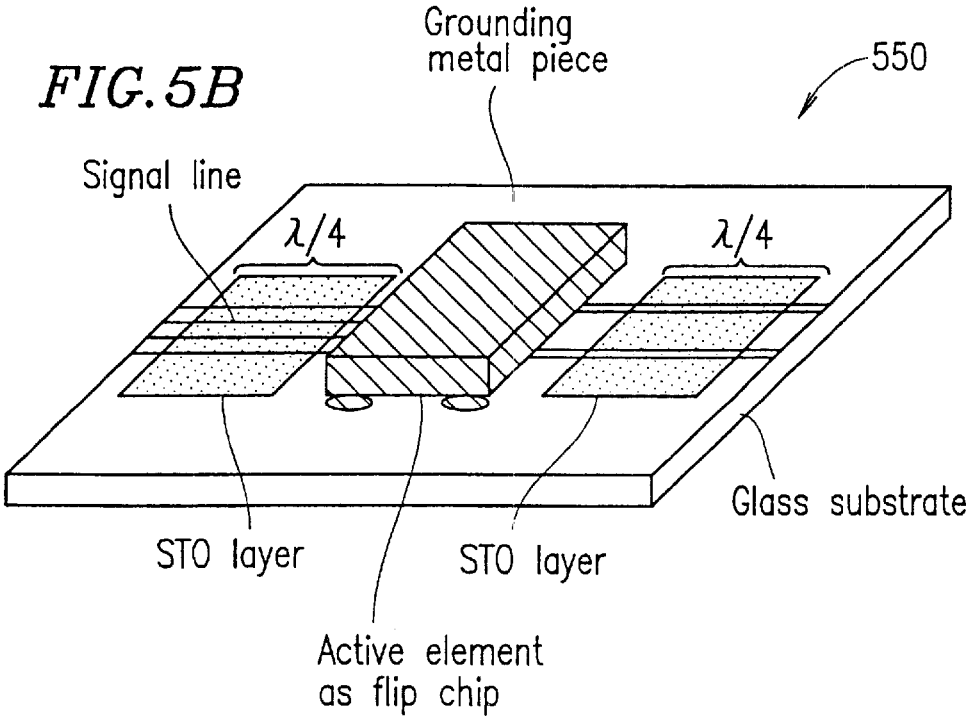
FIG. 5B is a schematic isometric view of a flip-chip assembly IC acting as a high frequency apparatus according to the present invention.
Figure 6:
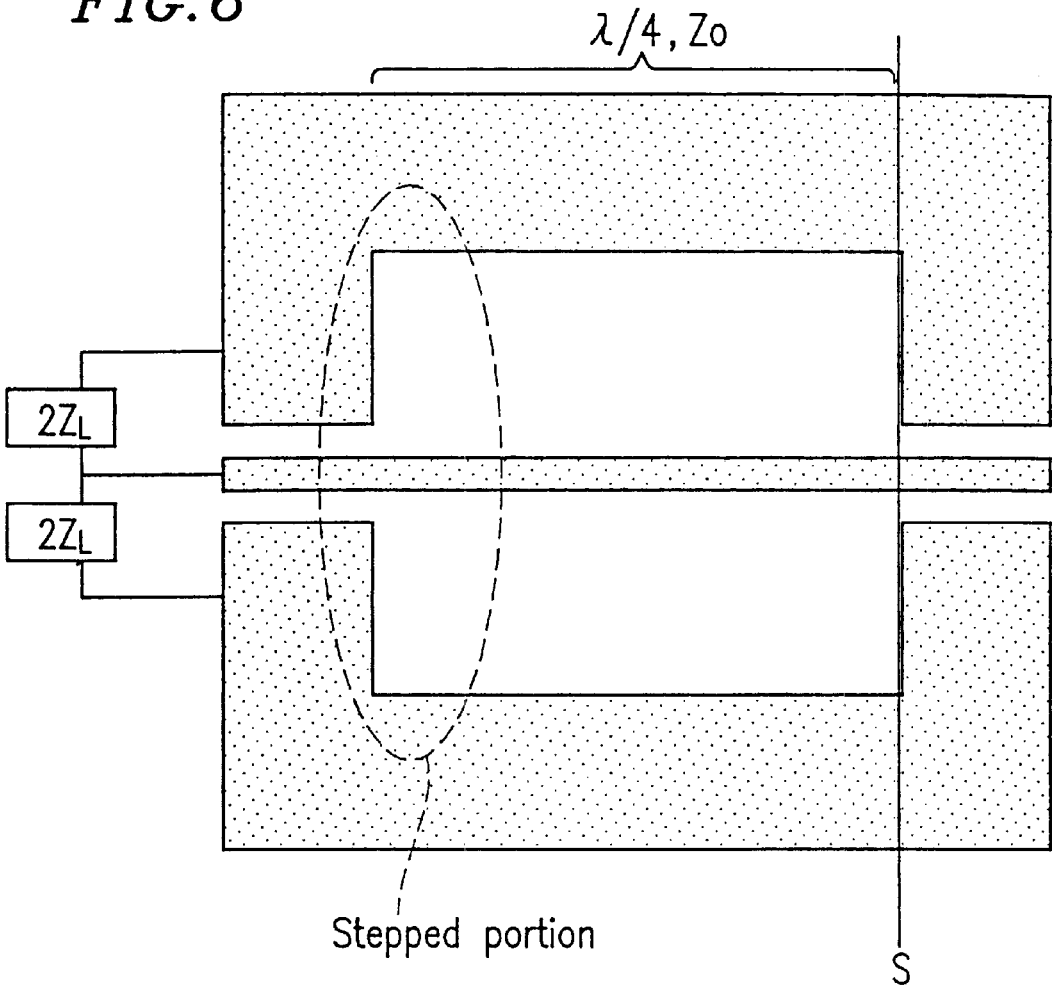
PRIOR ART FIG. 6
FIG. 6 is a schematic plan view of a conventional coplanar waveguide.
Figure 7A:
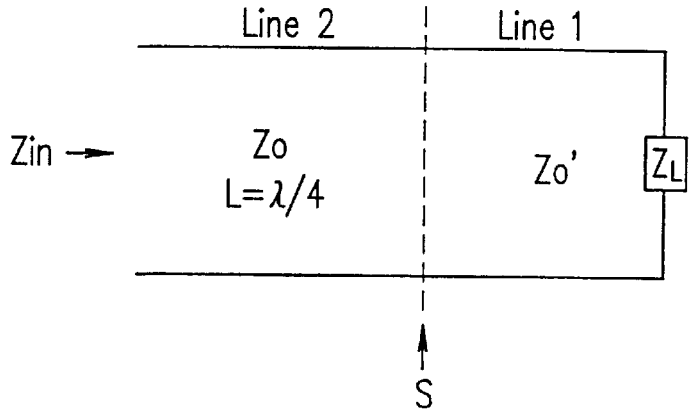
FIG. 7A shows ideal impedance transform.
Figure 7B:
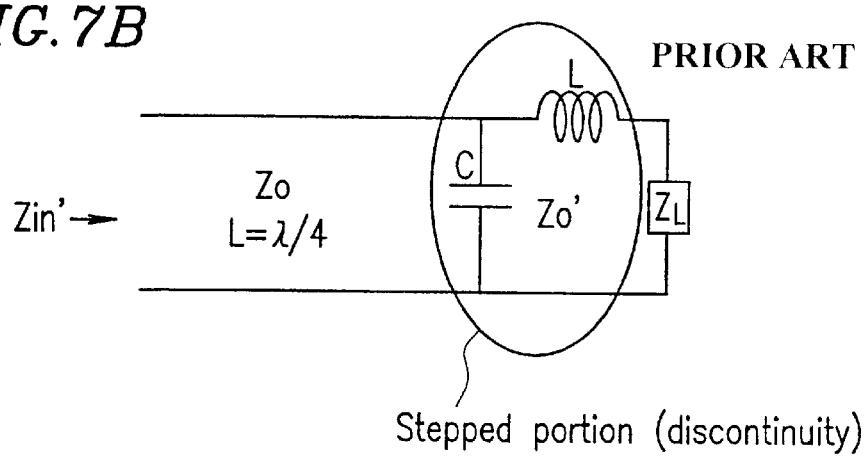
FIG. 7B PRIOR ART
FIG. 7B shows actual impedance transform performed by the conventional coplanar waveguide shown in FIG. 6.
Figure 7C:
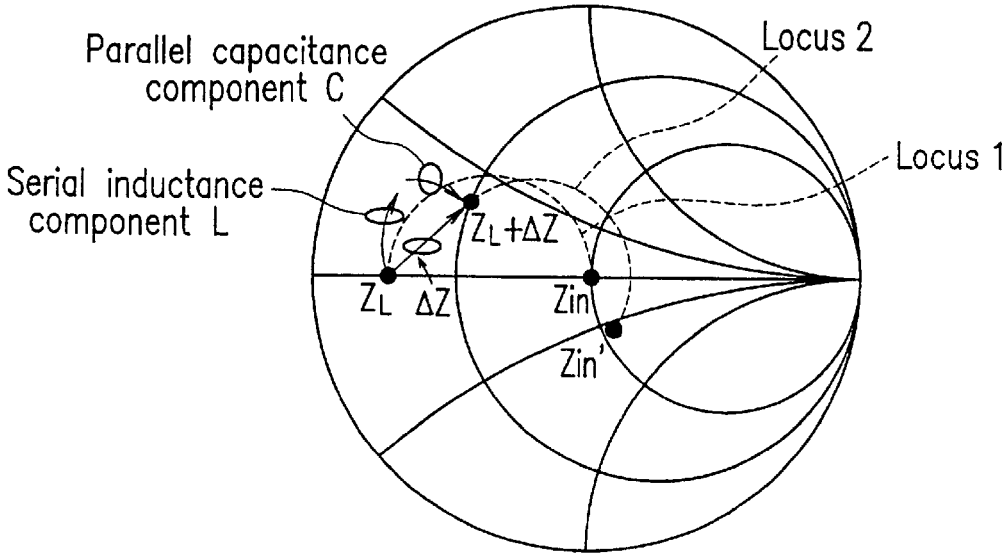
FIG. 7C is a Smith chart illustrating the impedance transform shown in FIG. 7B.

Instead of the GaAs substrate 401, it is also possible to use a glass substrate and mount an active element in place of a part of the CPW 406 or mount a circuit having an active element in place of a part of the CPW 406 in the form of a flip chip. In this case, a flip-chip assembly IC can be produced. FIG. 5B shows such a flip-chip assembly IC 550 acting as a high frequency apparatus according to the present invention.

The MMIC 500 and the flip-chip assembly IC 550 are both applicable to any of the above-described and any other possible examples of the present invention.

As described above, according to the present invention, the influence of parasitic impedance components, caused by a stepped portion or the like, on the load impedance is suppressed so as to reduce the offset in the load impedance. Thus, a high frequency apparatus according to the present invention can appropriately match the impedance with the load and transform a low impedance of a load such as a power device or the like to an impedance of or around 50 Ω, which is the standard impedance, with ease and certainty.

The present invention provides a high frequency apparatus capable of ideal impedance transform of a thin film transmission line.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A high frequency apparatus, comprising:

a dielectric substrate having a surface including a first area and at least one second area;

a first dielectric thin layer provided on a portion of a first area; and a uniplanar transmission line provided on the first dielectric thin layer and on a portion of the second area, such that characteristic impedance of the uniplanar transmission line is different between the first and second areas, the uniplanar transmission line extending, continuously on the second area and the first dielectric thin layer so as to impedance match the transmission line to a load connected to the transmission line.

2. A high frequency apparatus according to claim 1, wherein a dielectric constant of the uniplanar transmission line in the first area is different from a dielectric constant of the uniplanar transmission line in the second area.

3. A high frequency apparatus according to claim 1, wherein the surface of the dielectric substrate is exposed in the second area.

4. A high frequency apparatus according to claim 1, further comprising a second dielectric thin layer provided on the second area of the surface of the dielectric substrate.

5. A high frequency apparatus according to claim 4, wherein a thickness of the first dielectric thin layer is larger than a thickness of the second dielectric thin layer.

6. A high frequency apparatus according to claim 4, wherein a thickness of the first dielectric thin layer is smaller than a thickness of the second dielectric thin layer.

7. A high frequency apparatus according to claim 1, wherein the first dielectric thin layer is formed of a dielectric material including an oxide of titanium.

8. A high frequency apparatus according to claim 7, wherein the dielectric material including an oxide of titanium is $SrTiO_3$.

9. A high frequency apparatus according to claim 7, wherein the dielectric material including an oxide of titanium is $(Ba, Sr)TiO_3$.

10. A high frequency apparatus according to claim 4, wherein the second dielectric thin layer is formed of a dielectric material including an oxide of titanium.

11. A high frequency apparatus according to claim 10, wherein the dielectric material including an oxide of titanium is $SrTiO_3$.

12. A high frequency apparatus according to claim 10, wherein the dielectric material including an oxide of titanium is $(Ba, Sr)TiO_3$.

13. A high frequency apparatus according to claim 4, wherein the first dielectric thin layer and the second dielectric thin layer are formed of a dielectric material including an oxide of titanium.

14. A high frequency apparatus according to claim 13, wherein the dielectric material including an oxide of titanium is $SrTiO_3$.

15. A high frequency apparatus according to claim 13, wherein the dielectric material including an oxide of titanium is $(Ba, Sr)TiO_3$.

16. A high frequency apparatus according to claim 4, wherein the second dielectric thin layer is formed of $SiO_{1-x}N_x$ ($0<=x<1$).

17. A high frequency apparatus according to claim 4, wherein the first dielectric thin layer and the second dielectric thin layer is formed of $SiO_{1-x}N_x$ ($0<=x<1$).

18. A high frequency apparatus according to claim 1, wherein the first dielectric thin layer is formed of $SiO_{1-x}N_x$ ($0<=x<1$).

19. A high frequency apparatus according to claim 1, wherein the uniplanar transmission line includes a plurality of metal lines, and a line distance between the plurality of metal lines is changed in a tapered number at a prescribed position.

20. A high frequency apparatus according to claim 1, wherein the uniplanar transmission line is a coplanar waveguide.

21. A high frequency apparatus according to claim 1, wherein the dielectric substrate is a GaAs substrate.

22. A high frequency apparatus according to claim 21, further comprising an active element on the GaAs substrate.

23. A high frequency apparatus according to claim 1, wherein the dielectric substrate is a glass substrate.

24. A high frequency apparatus according to claim 20, further comprising an active element on the glass substrate.

25. A high frequency apparatus, comprising:

a dielectric substrate;

a uniplanar transmission line including a signal line and a pair of grounding lines having the signal line interposed therebetween;

a dielectric thin layer provided on a part of the dielectric substrate and below at least a part of the signal line and at least a part of each of the pair of grounding lines, wherein the signal line and pair of grounding lines extend continuously over the dielectric substrate including the part provided with the dielectric thin layer, such that characteristic impedance of the uniplanar transmission line is different between the part which extends over the dielectric substrate and the part which extends over the dielectric thin layer; and a load coupled between the signal line and each of the pair of grounding lines.

* * * * *